US005692612A

United States Patent [19]

Weder et al.

[11] Patent Number: 5,692,612

[45] Date of Patent: *Dec. 2, 1997

[54] SHIPPING CARTON AND METHOD FOR SHIPPING FLORAL GROUPINGS

[75] Inventors: Donald E. Weder, Highland, Ill.; Sue Corbett, Edmond, Okla.

[73] Assignee: Southpac Trust International, Inc.; not individually, but as trustee of The Family Trust U/T/A dated Dec. 8, 1995, Charles A. Codding, Authorized Signatory for Southpac Trust International, Inc. Trustee

[ * ] Notice: The term of this patent shall not extend beyond the expiration date of Pat. No. 5,564,567.

[21] Appl. No.: 474,356

[22] Filed: Jun. 7, 1995

Related U.S. Application Data

[63] Continuation-in-part of Ser. No. 375,451, Jan. 19, 1995, which is a continuation of Ser. No. 216,749, Mar. 23, 1994, Pat. No. 5,407,072, which is a continuation-in-part of Ser. No. 93,109, Jul. 16, 1993, Pat. No. 5,311,992, which is a continuation-in-part of Ser. No. 892,441, Jun. 2, 1992, Pat. No. 5,240,109, which is a continuation of Ser. No. 831,767, Feb. 5, 1992, Pat. No. 5,148,918, which is a continuation-in-part of Ser. No. 692,329, Apr. 26, 1991, Pat. No. 5,092,465.

[51] Int. Cl.[6] ..... B65D 85/52

[52] U.S. Cl. ..... 206/423; 206/460; 47/84

[58] Field of Search ..... 206/423, 460, 206/495, 813; 47/72, 84

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren | 206/80 |
| 2,373,634 | 4/1945 | Wagner | 117/122 |
| 2,578,583 | 12/1951 | O'Brien | 206/65 |
| 2,664,670 | 1/1954 | Mulford | 47/37 |
| 2,721,022 | 10/1955 | Billerbeck | 229/52 |
| 2,744,624 | 5/1956 | Hoogstoel et al. | 206/65 |
| 2,871,080 | 1/1959 | Shelly | 312/107 |
| 3,113,673 | 12/1963 | Stein | 206/65 |
| 3,322,323 | 5/1967 | Greene et al. | 229/37 |
| 3,389,784 | 6/1968 | Hendricks et al. | 206/47 |
| 3,466,214 | 9/1969 | Polk et al. | 156/213 |
| 3,734,280 | 5/1973 | Amneus et al. . | |
| 3,754,642 | 8/1973 | Stidolph | 206/45.14 |
| 3,883,990 | 5/1975 | Stidolph | 47/58 |
| 3,924,354 | 12/1975 | Gregoire | 47/34.11 |
| 4,053,049 | 10/1977 | Beauvais | 206/318 |
| 4,170,301 | 10/1979 | Jones et al. | 206/423 |
| 4,396,120 | 8/1983 | Morita | 206/460 |
| 4,470,508 | 9/1984 | Yen | 206/334 |
| 5,111,638 | 5/1992 | Weder | 53/397 |
| 5,240,109 | 8/1993 | Weder et al. | 206/423 |
| 5,407,072 | 4/1995 | Weder et al. | 206/460 X |

FOREIGN PATENT DOCUMENTS

| | | |
|---|---|---|
| 192843 | 11/1957 | Austria . |
| 2221936 | 10/1974 | France . |
| 1-61058 | 4/1989 | Japan . |
| 4352664 | 12/1992 | Japan . |
| 2735225 | 4/1978 | Netherlands . |
| 26878 | of 1913 | United Kingdom . |

*Primary Examiner*—Jacob K. Ackun
*Attorney, Agent, or Firm*—Dunlap & Codding, P.C.

[57] ABSTRACT

A shipping carton including a box assembly and a plurality of pots containing floral groupings. A bonding material is applied to the lower end of the pots and the pots containing floral groupings are disposed in the retaining space of the box so that the bonding material engages and connects each of the pots to the box. Retaining inserts may be disposed in the retaining space of the box to retain the growing medium contained in the pots within the pots during movement or shipment of the box assembly. Methods of using a shipping box.

47 Claims, 12 Drawing Sheets

SHIPPING CARTON AND METHOD FOR SHIPPING FLORAL GROUPINGS

CROSS-REFERENCE TO RELATED APPLICATIONS

This application is a continuation-in-part of U.S. Ser. No. 08/375,451, filed Jan. 19, 1995, now pending entitled SHIPPING CARTON AND METHOD FOR SHIPPING FLORAL GROUPINGS; which is a continuation of U.S. Ser. No. 08/216,749, filed Mar. 23, 1994, entitled SHIPPING CARTON AND METHOD FOR SHIPPING FLORAL GROUPINGS, now U.S. Pat. No. 5,407,072; which is a continuation-in-part of U.S. Ser. No. 08/093,109, filed Jul. 16, 1993, entitled RETAINING FLAP FOR SHIPPING CARTONS, now U.S. Pat. No. 5,311,992; which is a continuation-in-part of U.S. Ser. No. 07/892,441, filed Jun. 2, 1992, entitled SHIPPING CARTON FOR FLORAL GROUPING ASSEMBLIES, now U.S. Pat. No. 5,240,109; which is a continuation of U.S. Ser. No. 07/831,767, filed Feb. 5, 1992, entitled SHIPPING CARTON FOR FLORAL GROUPING ASSEMBLIES, now U.S. Pat. No. 5,148,918; which is a continuation-in-part of U.S. Ser. No. 07/692,329, filed Apr. 26, 1991, entitled SHIPPING CARTON FOR FLORAL GROUPING ASSEMBLIES, now U.S. Pat. No. 5,092,465.

FIELD OF THE INVENTION

The present invention generally relates to an improved shipping carton for flower pots and methods of using same.

DESCRIPTION OF THE PREFERRED EMBODIMENTS

Figure 1:
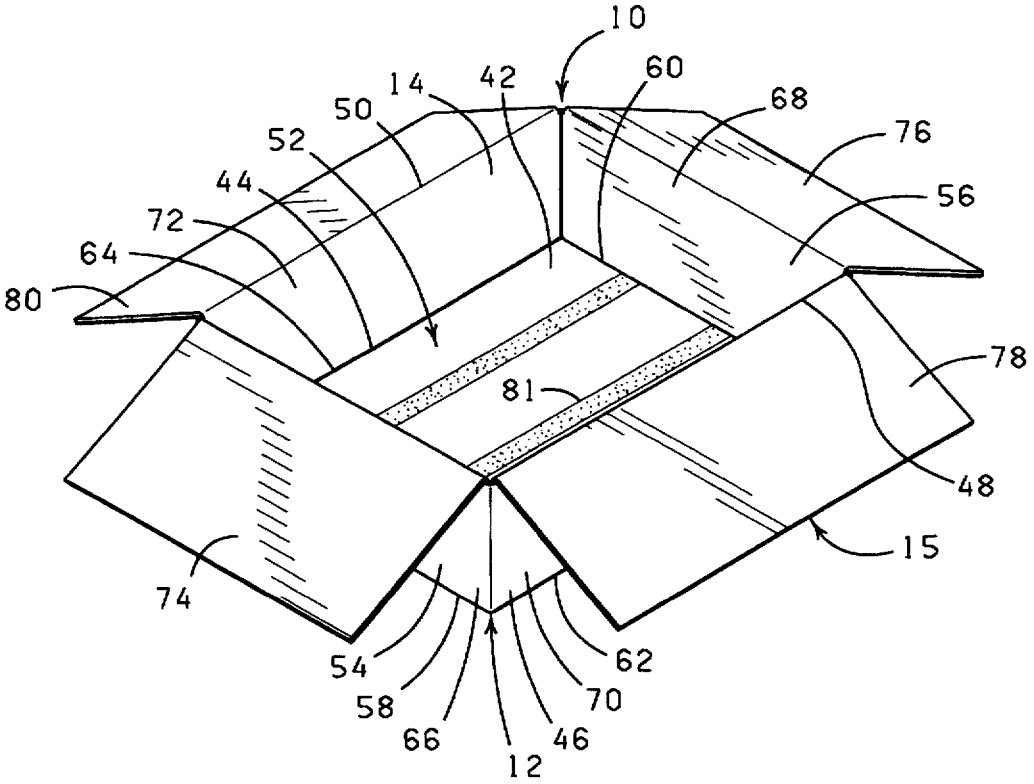
FIG. 1 is a perspective view of a box assembly constructed in accordance with the present invention.
Figure 2:
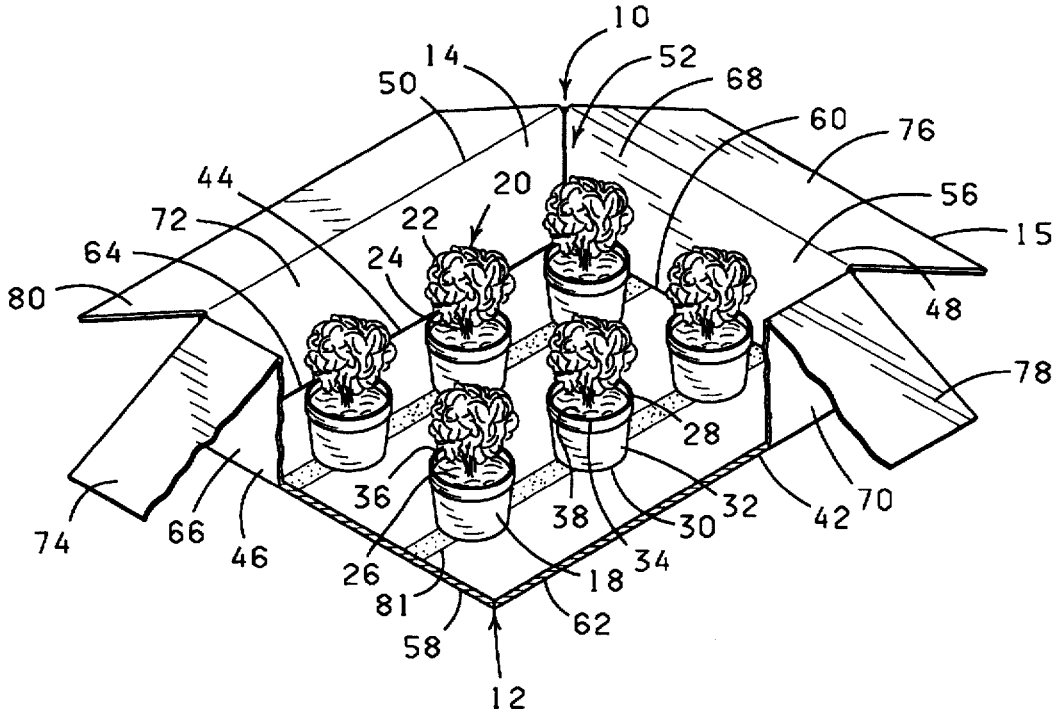
FIG. 2 is a perspective cutaway view of a box assembly showing a plurality of flower pots which contain floral grouping assemblies disposed in the box assembly.

The Embodiments And Method Of FIGS. 1 and 2

Shown in FIGS. 1 and 2 is a shipping carton which is constructed in accordance with the present invention and designated by the general reference numeral 10. The shipping carton includes a box assembly 12. The box assembly 12 comprises a box 14 and box flaps generally designated as 15.

The box assembly 12 is particularly shaped and sized to accommodate a plurality of flower pots, only one of which is designated as 18 (FIG. 2). The term "flower pot" refers to any type of container used for holding a floral grouping or a potted plant. Examples of flower pots used in accordance with the present invention include, but are not limited to, clay pots, plastic pots, wood pots, and the like. "Floral grouping" as used herein means cut fresh flowers, artificial flowers, a single flower, other fresh and/or artificial plants or other floral materials, and may include other secondary plants and/or ornamentation or artificial or natural materials which add to the aesthetics of the overall floral grouping. The floral grouping 20 comprises a bloom or foliage portion 22, a stem portion 24 and a root portion 25 (shown in FIGS. 9, 14 and 17). However, it will be appreciated that the floral grouping 20 may consist of only foliage 22 or only a single bloom (not shown). Each flower pot 18 contains a floral grouping 20 partially disposed in a growing medium 26. The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The flower pots 18 may be further described as having an upper end 28, a lower base 30, an outer surface 32, an opening 34 intersecting the upper end 28 forming an inner surface 36 and a retaining space 38, wherein the growing medium 26 and the floral groupings 20 are disposed in the retaining space 38 of the flower pot 18.

The box 14 comprises a base 42 having an outer periphery 44. A plurality of side walls 46 (only one of which is designated by the numeral 46) are connected to the base 42, and the plurality of side walls 46 extend about the outer periphery 44 of the base 42. Each of the plurality of side walls 46 extends a distance about perpendicularly from the base 42 with the plurality of side walls 46 each interconnecting and the interconnected plurality of sidewalls 46 each terminating with an upper end 48 forming an open upper end 50 of the box 14. The side walls 46 and the base 42 cooperate to partially enclose a retaining space 52.

The box 14 has an outer surface 54 and an inner surface 56. The outer and the inner surfaces 54 and 56 each are formed by portions of the base 42 and portions of the side walls 46.

The base 42 more particularly comprises a first end 58, a second end 60, a first side 62 and a second side 64. The base 42 generally is rectangularly shaped, although it will be appreciated that the base 42 may comprise any geometric or non-geometric shape. As shown in FIG. 1, the side walls 46 more particularly comprise a first end wall 66, a second end wall 68, a first side wall 70 and a second side wall 72. The first end wall 66 is connected to the base 42 and extends generally along the first end 58 of the base 42. The second end wall 68 is connected to the base 42 and extends generally along the second end 60 of the base 42. The first side wall 70 is connected to the base 42 and extends generally along the first side 62 of the base 42. The second side wall 72 is connected to the base 42 and extends generally along the second side 64 of the base 42. The first end wall 66, the second end wall 68, the first side wall 70 and the second side wall 72 are interconnected to form the continuous side wall 46 extending about the outer periphery 44 of the base 42.

As shown in FIG. 1, the box lid 82 comprises a first lid flap 74, a second lid flap 76, a third lid flap 78 and a fourth lid flap 80. The first lid flap 74 is connected to the upper end of the first end wall 66, the first lid flap 74 extending along the entire length of the first end wall 66 and extending a distance therefrom. The second lid flap 76 is connected to the upper end of the second end wall 68 and extends along the entire length of the upper end of the second end wall 68 and a distance therefrom. The third lid flap 78 is connected to the upper end of the first side wall 70 and extends along the entire length of the first side wall 70 and a distance therefrom. The fourth lid flap 80 is connected to the upper end of the second side wall 72 and extends along the entire length of the second side wall 72 and a distance therefrom. The lid flaps 74, 76, 78 and 80 are shown in FIG. 1 in the opened position wherein each of the lid flaps 74, 76, 78 and 80 are folded away from the opened upper end 50 of the box 14.

Each of the lid flaps 74, 76, 78 and 80 is movable to a position wherein each of the lid flaps 74, 76, 78 and 80 extends over a portion of the opened upper end 50 of the box 14 and generally over at least a portion of the retaining space 52. The lid flaps 74, 76, 78 and 80 cooperate with the box 14 to substantially enclose and encompass the retaining space 52 in the closed position of the lid flaps 74, 76, 78 and 80 (not shown).

The box assembly 12 includes a connecting bonding material 81 applied to the base 42 of the box assembly 12. The term "connecting bonding material" as used herein means an adhesive, such as a pressure sensitive adhesive, or cohesive. Where the connecting bonding material is a cohesive, a similar cohesive material must be placed on the flower pot for bondingly contacting and bondingly engaging with the cohesive material on the base of the carton 10. The term "connecting bonding material" also includes a thickened adhesive such as but not by way of limitation, rubber cement. As shown in FIGS. 1 and 2, the connecting bonding material 81 is disposed on the base 42 of the carton 10 in strips of connecting bonding material, only one of which is designated 81, although the connecting bonding material 81 could also be applied to the base 42 of the carton 10 in the form of spaced-apart spots or in any pattern including covering the entire base 42 of the carton 10 with connecting bonding material 81. The term "spot" or "spots" includes any geometric or non-geometric shape including, but not limited to, what is commonly referred to as strips.

A conventional box may also be used comprising a box insert (not shown) substantially similar to the base 42 of the box 14. The bonding material 81 in that case would be disposed on the upper surface of the box insert rather than on the upper surface of the box base 42.

In a method of operation, a box assembly 12 as described above and a plurality of flower pots 18 containing floral groupings 20 are provided. The flower pots 18 are disposed one at a time in the retaining space 52 of the box assembly 12 so that the lower end base 30 of each flower pot 18 engages at least one strip of connecting bonding material 81 as shown in FIG. 2. Each flower pot 18 is thereby bondingly engaged to the base 42 of the box assembly 12 whereby the flower pots 18 are substantially prevented from moving during movement of the box assembly 12, such as during shipment of the box assembly 12. After the pots 18 containing floral groupings 20 have been disposed in the retaining space 52, the first and second lid flaps 74 and 76 are moved to the closed position. The third and fourth lid flaps 78 and 80 are then each moved to the closed position generally overlaying the first and second lid flaps 74 and 76. The third and fourth lid flaps 78 and 80 may then be secured in this closed position via an adhesive tape or other securing means thereby securing all of the lid flaps 74, 76, 78 and 80 in the closed position covering the pots 18 and floral groupings 20.

It will be appreciated that the base 42 of the box assembly 12 shown in all embodiments may be printed or otherwise marked with a designation as to the desired location for the disposition of each of the flower pots 18 to be disposed on the base 42 of the box assembly 12.

Figure 3:
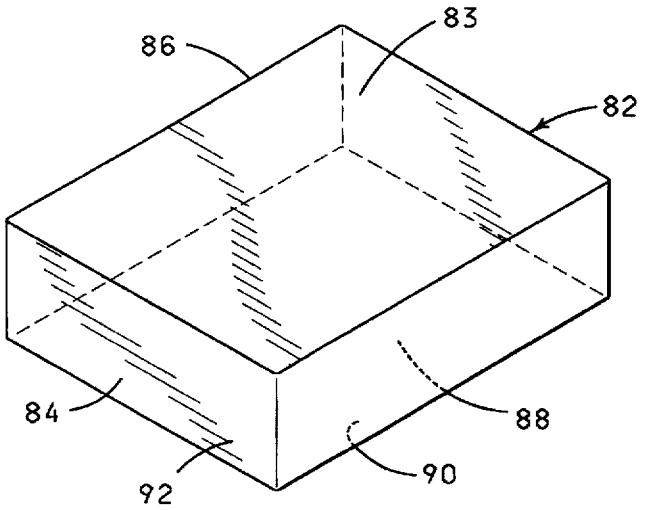
FIG. 3 is a perspective view of a box lid.
Figure 4:
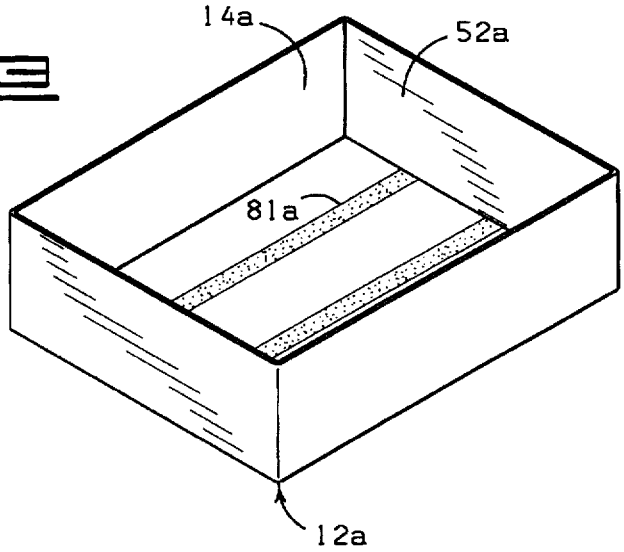
FIG. 4 is a perspective view of a box used with the box lid shown in FIG. 3 in accordance with the present invention.
Figure 5:
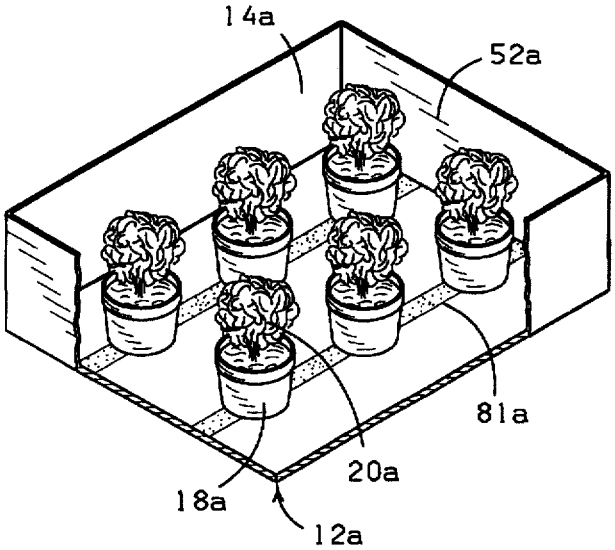
FIG. 5 is a perspective cutaway view of the box assembly shown in FIG. 4 showing flower pots containing floral groupings disposed in the box assembly.

The Embodiment And Method Of FIGS. 3, 4 and 5

Shown in FIGS. 3, 4 and 5 is a modified box assembly 12. The box assembly includes a box 14 (FIG. 4) which is constructed exactly like the box 14 shown in FIGS. 1 and 2 and described in detail, except that the box assembly **12*a* has no lid flaps 15. The box assembly 12*a* also includes a box lid 82 (FIG. 3). The box lid 82 has a base portion 83 and a plurality of side walls 84. (Only the side wall which is designated by the numeral 84). The plurality of side walls 84 are connected to the base portion 83 and extend generally about the entire outer periphery 86 of the base portion 83. The plurality of side walls 84 each extend generally perpendicularly downward from the base 83 and interconnect to cooperate with the base 83 to form a box receiving space 88. The box lid 82 has an inner surface 90 and an outer surface 92**.

In a method of operation (not shown), a box assembly **12*a* as described above and a plurality of flower pots 18*a* containing floral groupings 20*a* are provided. The flower pots 18*a* containing the floral groupings 20*a* are disposed in the retaining space 52*a* of the box 14*a* as shown in FIG. 5. The bonding strips 81*a* each bondingly engage the lower end base 30*a* of each flower pot 18*a* to connect the flower pots 18*a* containing floral groupings 20*a* to the base 42*a* to substantially prevent the movement of the flower pots 18*a* containing the floral groupings 20*a* in the box 14*a* during movements or shipment of the box assembly 12*a*. The box lid 82 is then placed over the open upper end 50*a* of the box 14*a* to a position where the box 14*a* and the box lid 82 cooperate to enclose the retaining space 52*a* of the box 14*a*** (not shown).

The Embodiments And Method Of FIGS. 6, 7, 8 and 9

Figure 6:
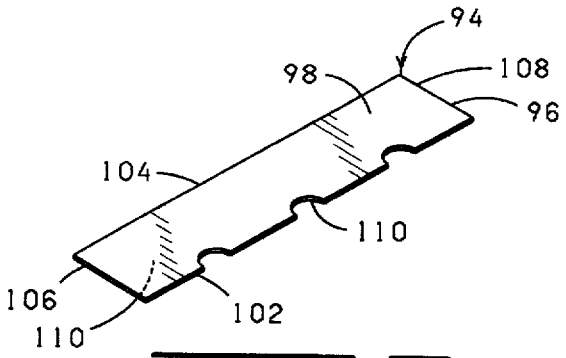
FIG. 6 is a perspective view of a retaining insert constructed in accordance with the present invention.

Shown in FIG. 6 is a retaining insert 94 which is generally rectangular in shape (although it will be understood that any geometric or non-geometric shape of retaining insert 94 may be used as long as the retaining insert operates in the manner described herein) and has an outer periphery 96, an upper surface 98, a lower surface 100, a first side 102, a second side 104, a first end 106 and a second end 108. A plurality of semi-circular cutouts, only one of which is designated 110, are formed in the first side 102. The plurality of cutouts 110 can be of any geometric or non-geometric shape as long as the plurality of cutouts 110 perform in the manner described herein.

Figure 7:
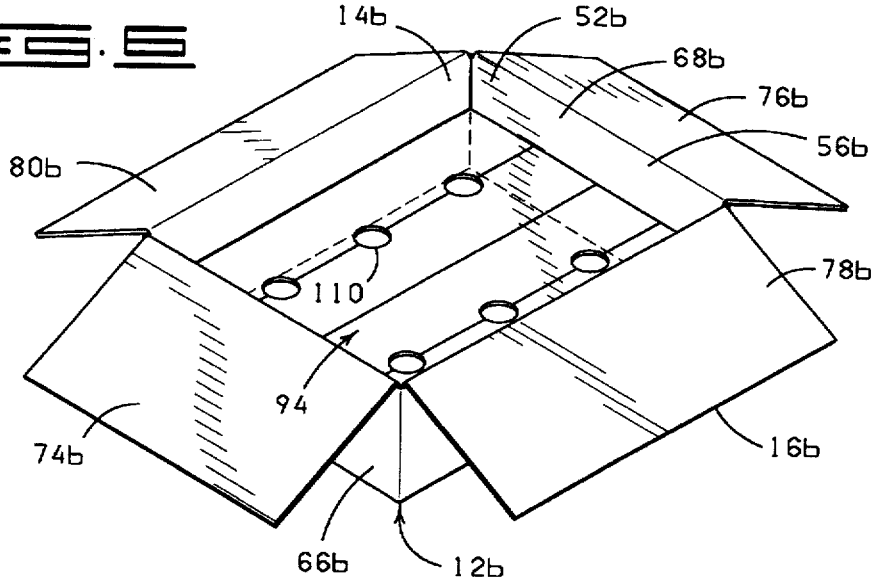
FIG. 7 is a perspective view of the box assembly shown in FIG. 1 with retaining inserts disposed therein.

Shown in FIG. 7 is a modified box assembly **12*b*. The box assembly 12*b* is constructed exactly like the box 14 and box lid 15 shown in FIGS. 1 and 2** and described in detail previously.

Figure 8:
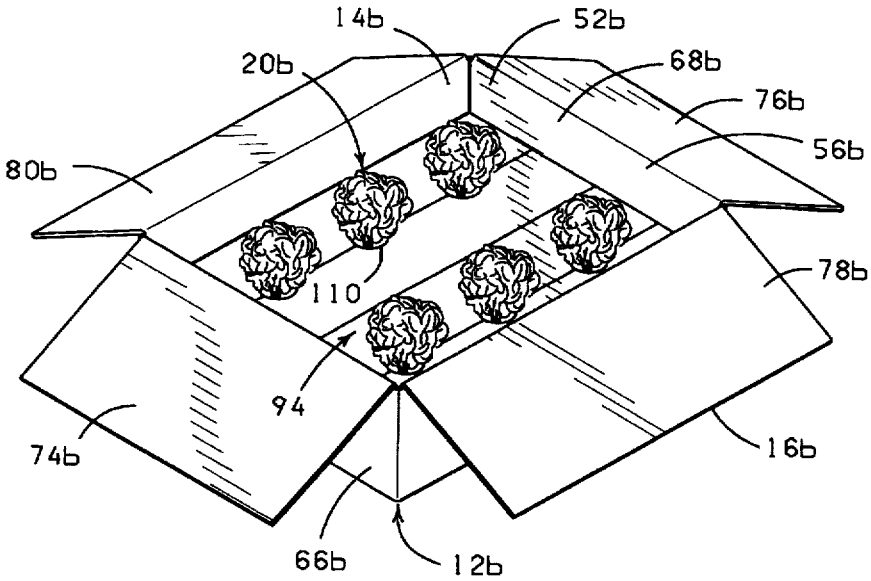
FIG. 8 is a perspective view of a box assembly similar to that in FIG. 1 having retaining inserts, flower pots and floral groupings disposed in the flower pots.
Figure 9:
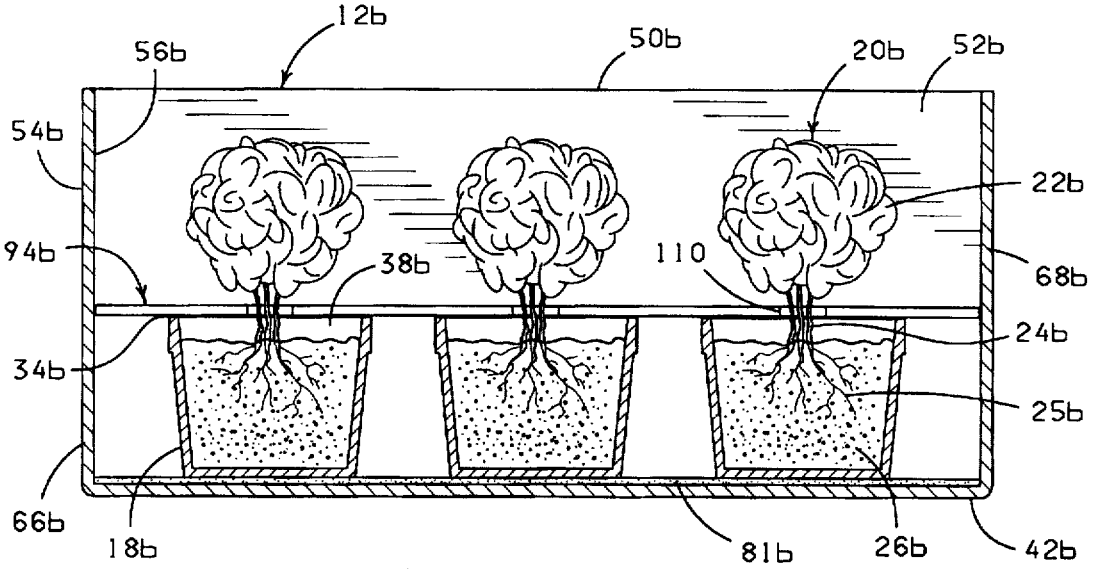
FIG. 9 is a cross section view of a box assembly shown in FIG. 8 showing the retaining inserts and the manner in which they communicate with the flower pots and floral groupings in accordance with the present invention.

The box assembly **12*b* includes a plurality of retaining inserts 94, only one of which is designated as 94, of the type shown in FIG. 6 and described in detail previously. The plurality of retaining cutouts 110 are shaped to encompass a portion of the floral groupings 20*b* as shown in FIGS. 8 and 9. The plurality of retaining inserts 94 extend from the inner surface 56*b* of the first end wall 66*b* of the box 14*b* across the retaining space 52*b* of the box 14*b* to the inner surface 56*b* of the second end wall 68*b* of the box 14*b*. The plurality of retaining inserts 94 are sized whereby the length of each retaining insert 94 is substantially equal to or slightly greater than the distance from the first end wall 66*b* to the second end wall 68*b*, the plurality of retaining inserts 94 thereby capable of being held in place by the friction between the end walls 66*b* and 68*b* and each retaining insert 94 when each retaining insert 94 is disposed in the retaining space 52*b* of the box 14*b***.

The plurality of retaining inserts 94 are disposed in pairs such that each retaining cutout 110 of each retaining insert 94 cooperate with each corresponding retaining cutout 110 of each of the plurality of the retaining inserts 94 to substantially encompass the stem portion **24*b* of the floral grouping 20*b* in one of the flower pots 18*b* (FIG. 9). The plurality of retaining inserts 94 substantially covers the opening 34*b* in the flower pot 20*b* thereby substantially enclosing the growing medium 26*b* (shown in FIG. 2) contained in the retaining space 38*b* of the flower pots 18*b* to retain the growing medium 26*b* and the floral groupings 20*b* in the flower pots 18*b* during movement or shipment of the box assembly 18*b***.

It will be understood that the retaining inserts 94 may be used singly, or more than one retaining insert may be used. Further, the retaining inserts 94 may be used wherein the cutouts 110 encompass at least a portion of each flower pot **18*b*. If more than one retaining insert 94 is utilized, the retaining inserts may encompass both a portion of the flower pot 18*b* and a portion of the stems 24*b* of the floral grouping 20*b***.

In a method of operation, a box assembly **12*b* as described above and a plurality of flower pots 18*b* containing floral groupings 20*b* are provided. The flower pots 18*b* are disposed one at a time in the retaining space 52*b* of the box assembly 12*b* so that the lower end base 30*b* of each flower pot 18*b* bondingly engages at least one strip of connecting bonding material 81*b*. Each flower pot 18*b* is thereby bondingly connected to the base 42*b* of the box assembly 12*b* whereby the flower pots 18*b* are substantially prevented from moving during movement of the box assembly 12*b*, such as during shipment of the box assembly 12*b*. Each of the plurality of retaining inserts 94 is then placed at least partially upon the openings 34*b* of the flower pots 18*b* whereby each retaining insert 94 communicates with the opening 34*b* of each flower pot 18*b* to substantially enclose the growing medium 26*b* within the retaining space 38*b* of the flower pot 18*b*. Alternatively, however, the box assembly 12*b* may not comprise any connecting bonding material 81*b*, only the plurality of retaining inserts 94, as just described, cooperating to both retain each flower pot 18*b* in place and retain the floral group 20*b* and growing medium 26*b*** in place, as previously described herein.

After the flower pots **18*b* containing floral groupings 20*b* and the retaining inserts 94*b* have been disposed in the retaining space 52b, the first and second lid flaps 74b and 76b are moved to the closed position. The third and fourth lid flaps 76b and 78b are then each moved to the closed position generally overlaying the first and second lid flaps 74b and 76b. The third and fourth lid flaps 78b and 80b may then be secured in this closed position via an adhesive tape or other securing means thereby securing all of the lid flaps 74b, 76b, 78b and 80b in the closed position covering the flower pots 18b and floral groupings 20b** (not shown).

Figure 10:
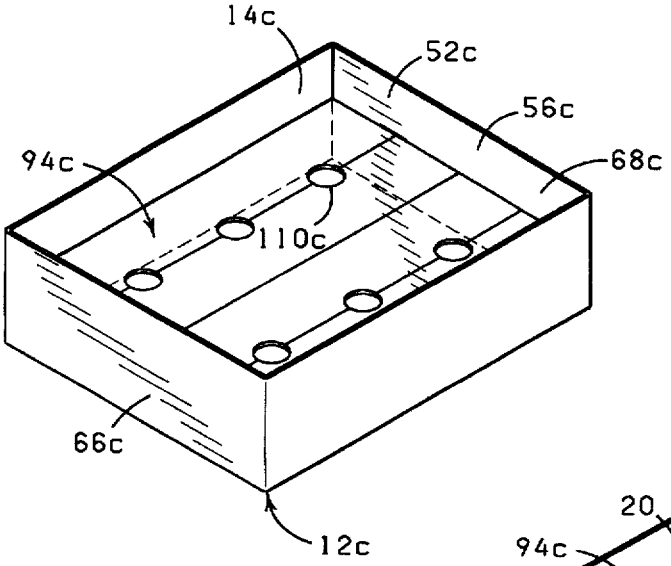
FIG. 10 is a perspective view of the box shown in FIG. 4 with retaining inserts disposed therein.
Figure 11:
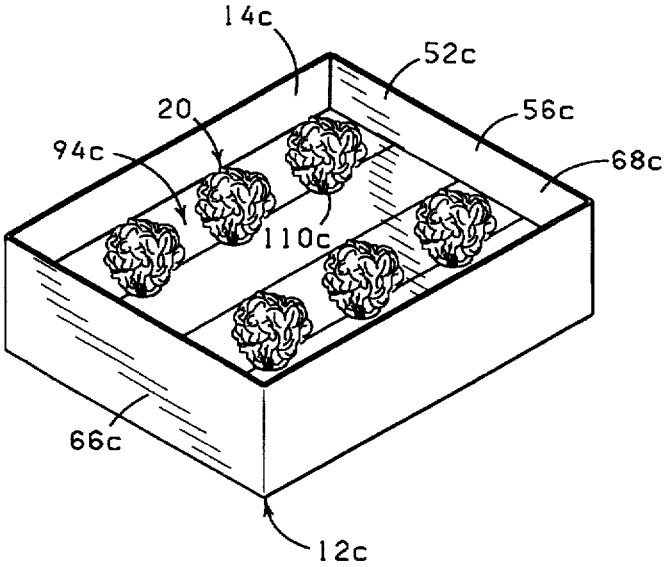
FIG. 11 is a perspective view of a box assembly similar to that in FIG. 10 showing retaining inserts and flower pots containing floral groupings disposed in the box.

The Embodiments Of FIGS. 10 and 11

Shown in FIG. 10 is a modified box assembly 12c. The box assembly 12c includes a box 14c and is constructed exactly like the box 14 and box lid 82 shown in FIGS. 3–5 and described in detail previously.

The box assembly 12c includes a plurality of retaining inserts 94c of the type shown in FIG. 6 and described in detail before. The plurality of retaining cutouts 110c are shaped to encompass a portion of the floral groupings 20c as shown in FIG. 11. The plurality of retaining inserts 94c extend from the inner surface 56c of the first end wall 66c of the box 14c across the retaining space 52c of the box 14c to the inner surface 56c of the second end wall 68c of the box 14c. The plurality of retaining inserts 94c are disposed in pairs such that each of the plurality of the retaining cutouts 110c of each of the plurality of retaining inserts 94c cooperate with each corresponding retaining cutout 110c of each of the plurality of retaining inserts 94c to encompass a substantial portion of the floral grouping 20c in one of the flower pots 18c (FIG. 5) thereby substantially enclosing the growing medium 26c (FIG. 5) contained in the flower pots 18c to retain the growing medium 26c and the floral groupings 20c in the flower pots 18c during movement or shipment of the box assembly 12c.

In a method of operation, a box assembly 12c as described above and a plurality of flower pots 18c containing floral groupings 20c are provided. The flower pots 18c are disposed one at a time in the retaining space 52c of the box assembly 12c so that the lower end base 30c of each flower pot 18c bondingly engages at least one strip of connecting bonding material 81c as shown in FIG. 7. Each flower pot 18c is thereby bondingly connected to the base 42c of the box 14c whereby the flower pots 18c are substantially prevented from moving during movement of the box assembly 12c, such as during shipment of the box assembly 12c. The retaining inserts 94c are then placed upon the opening 34c of the flower pots 18c whereby each retaining insert 94c communicates with the opening 34c of each flower pot 18c to substantially enclose the growing medium 26c with the retaining space 38c of the flower pot 18c.

The box lid 82c (not shown) is then placed over the open upper end 50c of the box 14c to a position where the box 14c and the box lid 82c cooperate to enclose the retaining space 52c of the box 14c (not shown).

Figure 12:
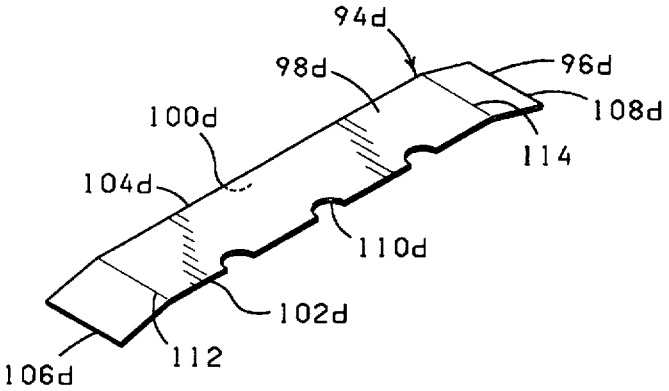
FIG. 12 is a perspective view of a retaining insert having foldable end pieces showing the ends in a partially folded position.
Figure 13:
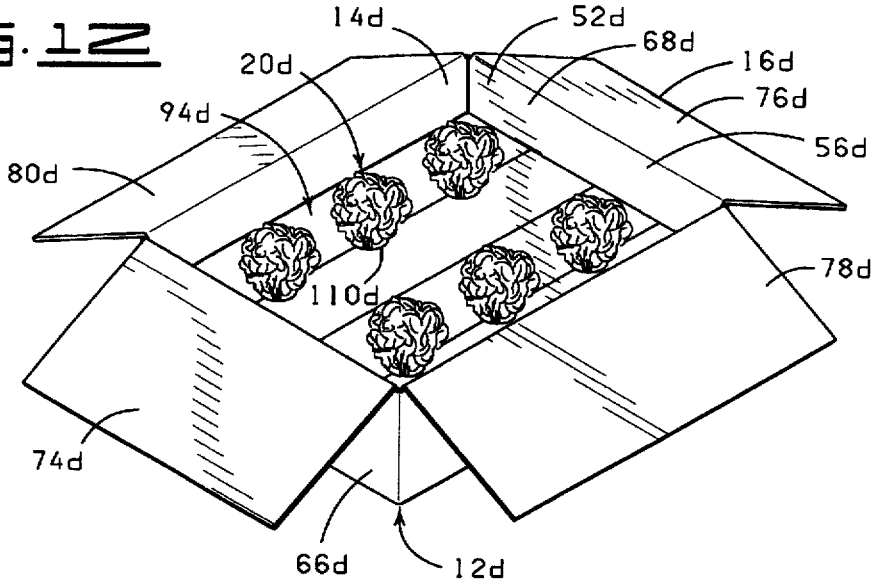
FIG. 13 is a perspective view of the box shown in FIG. 4 with retaining inserts as shown in FIG. 12 disposed therein.
Figure 14:
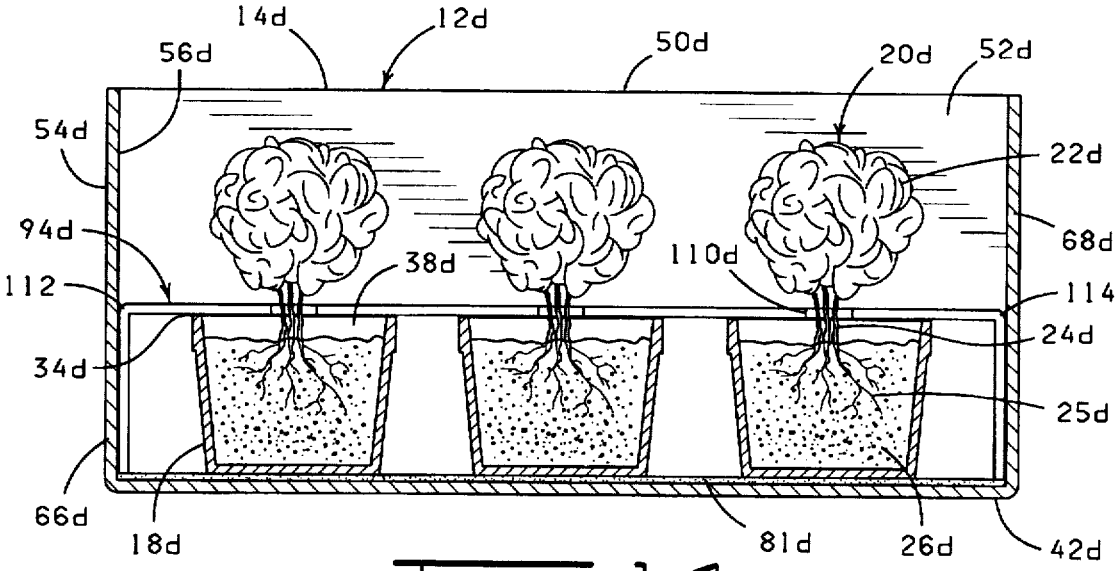
FIG. 14 is a cross section view of the box assembly shown in FIG. 13 showing the retaining inserts with foldable end pieces and the manner in which they communicate with the flower pots and floral groupings in accordance with the present invention.

The Embodiments And Methods Of FIGS. 12, 13 and 14

Shown in FIG. 12 is a retaining insert 94d which is similar to the retaining insert 94 shown in FIG. 6 except that the retaining insert 94d shown in FIG. 12 is greater in length. The retaining insert 94d shown in FIG. 12 is generally rectangular in shape (although, as previously described, any shape which functions as described herein may be utilized), and has an outer periphery 96d, an upper surface 98d, a lower surface 100d, a first side 102d, a second side 104d, a first end 106d and a second end 108d. A plurality of semi-circular cutouts, only one of which is designated 110d, are formed in the first side 102d.

A first fold line 112 is located between the first end 106d of the retaining insert 94d and the cutout 110d most proximal to the first end 106d of the retaining insert 94d. The fold line 112 extends a distance from and is parallel to the first end 106d of the retaining insert 94d. A second fold line 114 is located between the second end 108d of the retaining insert 94d and the cutout 110d most proximal to the second end 108d of the retaining insert 94d. The fold line 114 extends a distance from and is parallel to the second end 108d of the retaining insert 94d. The fold lines 112 and 114 may be a crease, a perforation or any structure which facilitates folding the retaining inserts 94d to the proper length.

Shown in FIG. 13 is a modified box assembly 12d. The box assembly 12d is constructed exactly like the box 14 and box lid 15 shown in FIGS. 1 and 2 and described in detail previously.

The box assembly 12d includes a plurality of retaining inserts, only one of which is designated as 94d, of the type shown in FIG. 12 and described in detail above. The plurality of retaining cutouts 110d are shaped to encompass the stem portion 24d of the floral groupings 20d as shown in FIGS. 13 and 14. The plurality of retaining inserts 94d extend from the inner surface 56d of the first end wall 66d of the box 14d across the retaining space 52d of the box 14d to the inner surface 56d of the second end wall 68d of the box 14d. When the plurality of retaining inserts 94d are folded along the fold lines 112 and 114 whereby the length of each of the plurality of retaining inserts 94d as folded is substantially equal to or slightly greater than the distance from the first end wall 66d to the second end wall 68d, the plurality of retaining inserts 94b thereby capable of being held in place by the friction between the end walls 66d and 68d and each retaining insert 94d when the plurality of retaining inserts 94d are disposed in the retaining space 52d of the box 14d. After the plurality of retaining inserts 94d are folded, the length of each insert 94d between the fold line 112 and the first end 106d of each retaining insert 94d is substantially equal to the height of the flower pots 18d. Likewise, the length of each insert 94d between the fold line 114 and the second end 108d of each retaining insert 94d is substantially equal to the height of the flower pots 18d. Additional support and retention of the plurality of retaining inserts 94d is thereby provided by the contact of the folded portion of each retaining insert 94d with the base 42d of the box assembly 12d.

The plurality of retaining inserts 94d are disposed in pairs such that the plurality of retaining cutouts 110d of each of the plurality of retaining inserts 94d cooperate with the corresponding plurality of retaining cutout 110d of each of the plurality of retaining inserts 94d to substantially encompass the stem portion 24d of the floral grouping 20d in one of the flower pots 18d (FIG. 14). The plurality of retaining inserts 94d substantially cover the opening 34d in the flower pot 18d thereby substantially enclosing the growing medium 26d (FIG. 14) contained in the retaining space 38d of the flower pots 18d to retain the growing medium 26d and the floral groupings 20d in the flower pots 18d during movement or shipment of the box assembly 12d.

In a method of operation, a box assembly 12d as described above and a plurality of flower pots 18d containing floral groupings 20d are provided. The flower pots 18d are disposed one at a time in the retaining space 52d of the box assembly 12d so that the lower end base 30d of each flower pot 18d bondingly engages at least one strip of connecting bonding material 81*d* as shown in FIGS. 14. Each flower pot 18*d* is thereby bondingly connected to the base 42*d* of the box assembly 12*d* whereby the flower pots 18*d* are substantially prevented from moving during movement of the box assembly 12*d*, such as during shipment of the box assembly 12*d*. The plurality of retaining inserts 94*d* are folded along the fold lines 112 and 114. The plurality of retaining inserts 94*d* are then placed at least partially upon each opening 34*d* of each flower pot 18*d* whereby the first and second ends 66*d* and 68*d* of each retaining insert 94*d* communicates with the base 42*d* of the box assembly 12*d*, and each retaining insert 94*d* communicates with the opening 34*d* of each flower pot 18*d* to substantially enclose the growing medium 26*d* within the retaining space 38*d* of the flower pot 18*d*.

After the flower pots 18*d* containing floral groupings 20*d* and the retaining inserts 94*d* have been disposed in the retaining space 52*d*, the first and second lid flaps 74*d* and 76*d* are moved to the closed position. The third and fourth lid flaps 78*d* and 80*d* are then each moved to the closed position generally overlaying the first and second lid flaps 74*d* and 76*d*. The third and fourth lid flaps 78*d* and 80*d* may then be secured in this closed position via an adhesive tape or other securing means thereby securing all of the lid flaps 74*d*, 76*d*, 78*d* and 80*d* in the closed position covering the flower pots 18*d* and floral groupings 20*d*.

Figure 15:
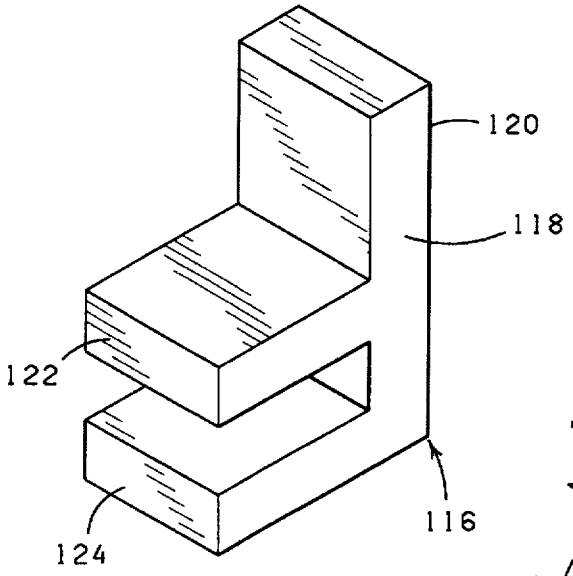
FIG. 15 is a perspective view of a clip which fastens one end of a retaining insert to an inner wall of a box assembly.
Figure 16:
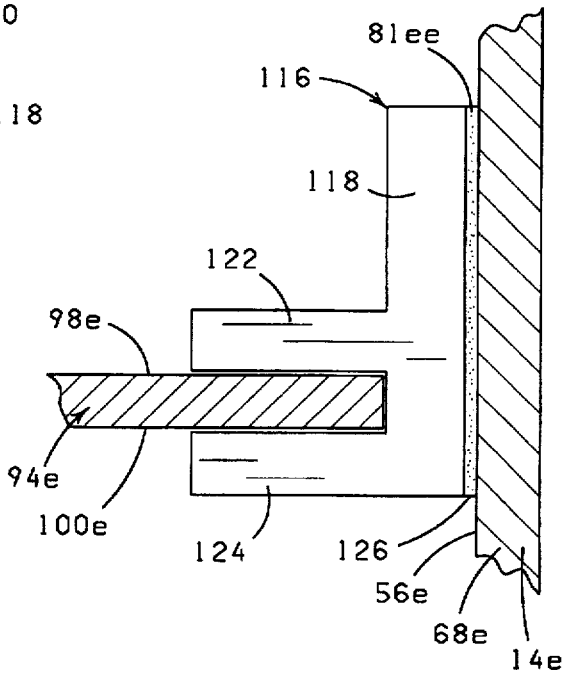
FIG. 16 is a side elevational view of a clip as it cooperates with a retaining insert.
Figure 17:
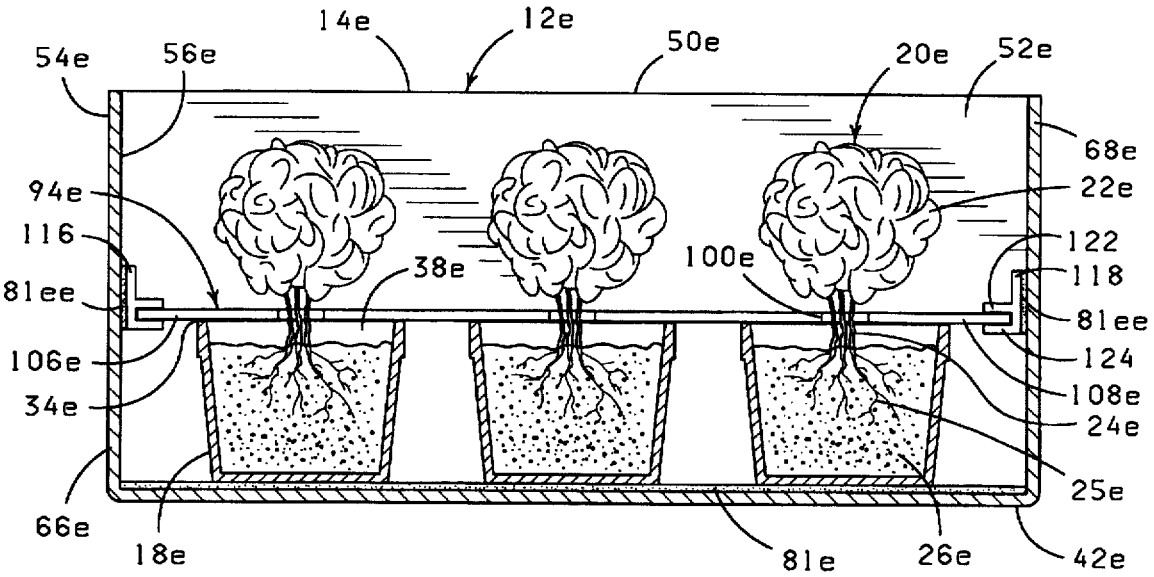
FIG. 17 is a cross section view of a box assembly shown in either FIG. 1 or FIG. 4 showing the retaining inserts and clips and the manner in which they communicate with the flower pots and floral groupings in accordance with the present invention.

The Embodiments Of FIGS. 15, 16 and 17

Shown in FIG. 17 is a box assembly 12*e* constructed exactly like the box shown in FIG. 11, but which includes a mechanism in the form of a clip 116 (FIG. 15) for securing the plurality of retaining inserts 94*e* to the inner surface 56*e* of the box assembly 12*e*. The clip 116 cooperates with each retaining insert 94*e* and the inner wall 56*e* of the box assembly 12*e*, as shown in FIGS. 16 and 17.

The plurality of retaining inserts 94*e*, such as those shown in detail in FIG. 6, may be secured to the inner surface 56*e* of the end walls 66*e* and 68*e* of the box assembly 12*e*. FIG. 15 shows one form of clip 116 that may be used for such a purpose, however, any clip or mechanism which operates in the manner described herein may be used. Further, the clip 116 may be secured to the box assembly 12*e* by any method and/or any mechanism known in the art. The clip 116 shown comprises a body 118 with a rear surface 120, an upper member 122 and a lower member 124. The upper member 122 and the lower member 124 of the clip 116 are spaced a distance apart, such distance approximating the thickness of a retaining insert 94*e* (FIG. 16).

FIG. 16 illustrates how the clip 116 operates to secure a retaining insert 94*e* to the inner surface 56*e* of the box assembly 12*e*. A connecting bonding material 81*ee* is disposed, for example, on the rear surface 120 of the body 118 of the clip 116 so that the body 118 of the clip 116 may be bonded to the inner surface 56*e* of the end walls 66*e* or 68*e* of the box assembly 12*e*. Two clips, only one of which is designated by the numeral 116, are mounted on the inner surface 56*e* of the box 14*e* for each of the plurality of retaining inserts 94*e* disposed in the retaining space 52*e* of the box 14*e* (FIG. 17). Each end 106*e* and 108*e* of each retaining insert 94*e* is disposed between the upper member 122 and the lower member 124 of a clip 116 at a height approximately equal to the height of the upper end 28*e* of the flower pots 18*e* so that the cutouts 110*e* substantially encompass the stem portion 24*e* of the floral groupings 20*e*. The growing medium 26*e* contained in the flower pots 18*e* is thereby substantially enclosed to retain the growing medium 26*e* and the floral groupings 20*e* within the flower pots 18*e* during movement or shipment of the box assembly 12*e*.

In a method of operation, a box assembly 12*e* as described above and a plurality of flower pots 18*e* containing floral groupings 20*e* are provided. The flower pots 18*e* are disposed one at a time in the retaining space 52*e* of the box assembly 12*e* so that the lower end base 30*e* of each flower pot 18*e* bondingly engages at least one strip of connecting bonding material 81*e* (FIG. 17). Each flower pot 18*e* is thereby bondingly connected to the base 42*e* of the box assembly 12*e*.

One clip 116 is bondingly mounted on the first end wall 66*e* of the box 14*e* for each retaining insert 94*e* that is to be disposed in the retaining space 52*e* of the box 14*e*. Likewise, one clip 116 is bondingly mounted on the second end wall 68*e* of the box 14*e* for each retaining insert 94*e* that is to be disposed in the retaining space 52*e* of the box 14*e*. The plurality of retaining inserts 94*e* are then placed upon the opening 34*e* of the flower pots 18*e* whereby each retaining insert 94*e* communicates with the opening 34*e* of each flower pot 18*e* to substantially enclose the growing medium 26*e* with the retaining space 38*e* of the flower pot 18*e*. The first end 106*e* of each retaining insert 94*e* is disposed between the upper member 122 and the lower member 124 of a clip 116 on the inner surface 56*e* of the first side wall 66*e* of the box 14*e*. The second end 108*e* of each retaining insert 94*e* may then be inserted between the upper member 122 and the lower member 124 of the clip 116 located on the inner surface 56*e* of the second side wall 68*e* of the box 14*e*. Alternatively, a clip 116 may be connected to the first end 106*e* of a retaining insert 94*e* and the second end 108*e* of a retaining insert 94*e* before the retaining insert 94*e* is disposed in the retaining space 52*e* of the box 14*e*. After connecting bonding material 81*ee* has been applied to the rear surface 120 of each clip 116, (or each clip 116 may be supplied with a pre-applied connecting bonding material 81*ee*), the retaining insert 94*e* with the clips 116 may be disposed in the retaining space 52*e* of the box 14*e* as described above. The clips 116 may then be secured to the first end wall 66*e* and the second end wall 68*e* of the inner surface 56*e* of the box 14*e* by applying pressure to the clips 116 thereby connectably engaging the clips 116 to the box 14*e*.

After the flower pots 18*e* containing floral groupings 20*e* have been disposed in the retaining space 52*e* by any method described herein, the first and second lid flaps 74*e* and 76*e* are moved to the closed position (not shown). The third and fourth lid flaps 78*e* and 80*e* are then each moved to the closed position generally overlaying the first and second lid flaps 74*e* and 76*e*. The third and fourth lid flaps 78*e* and 80*e* may then be secured in this closed position via an adhesive tape or other securing means thereby securing all of the lid flaps 74*e*, 76*e*, 78*e* and 80*e* in the closed position covering the flower pots 18*e* and floral groupings 20*e* (not shown).

Figure 18:
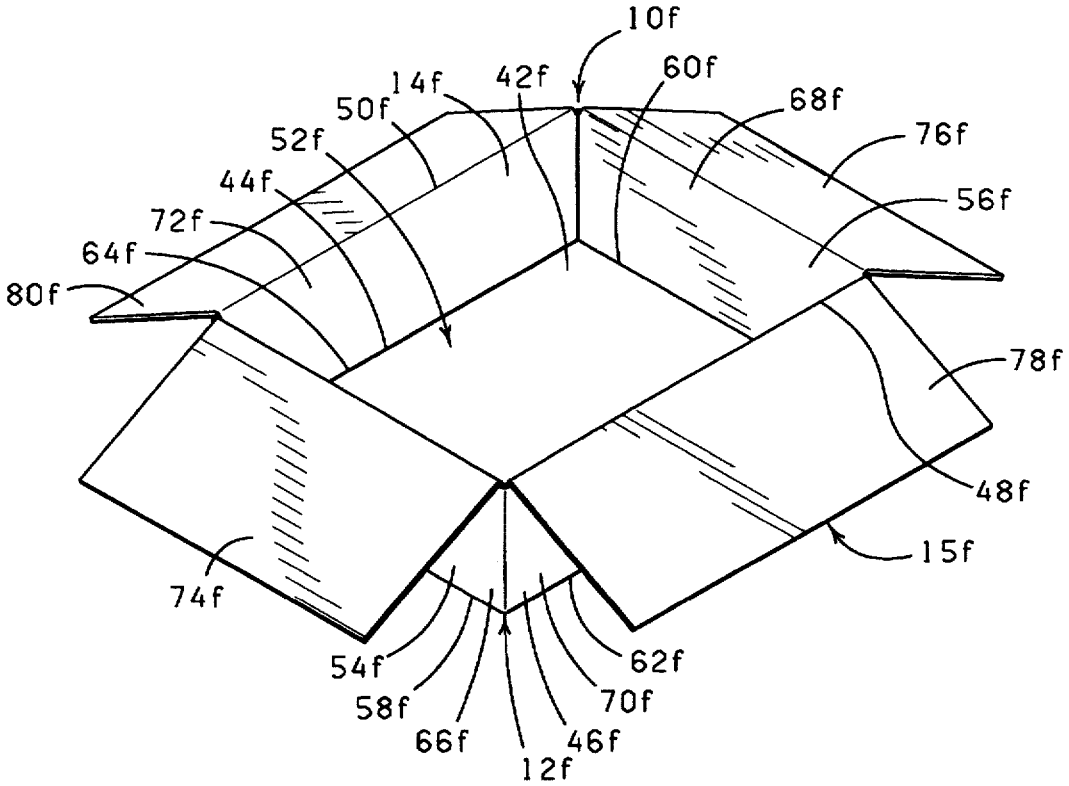
FIG. 18 is a perspective view of a box assembly constructed in accordance with the present invention.
Figure 19:
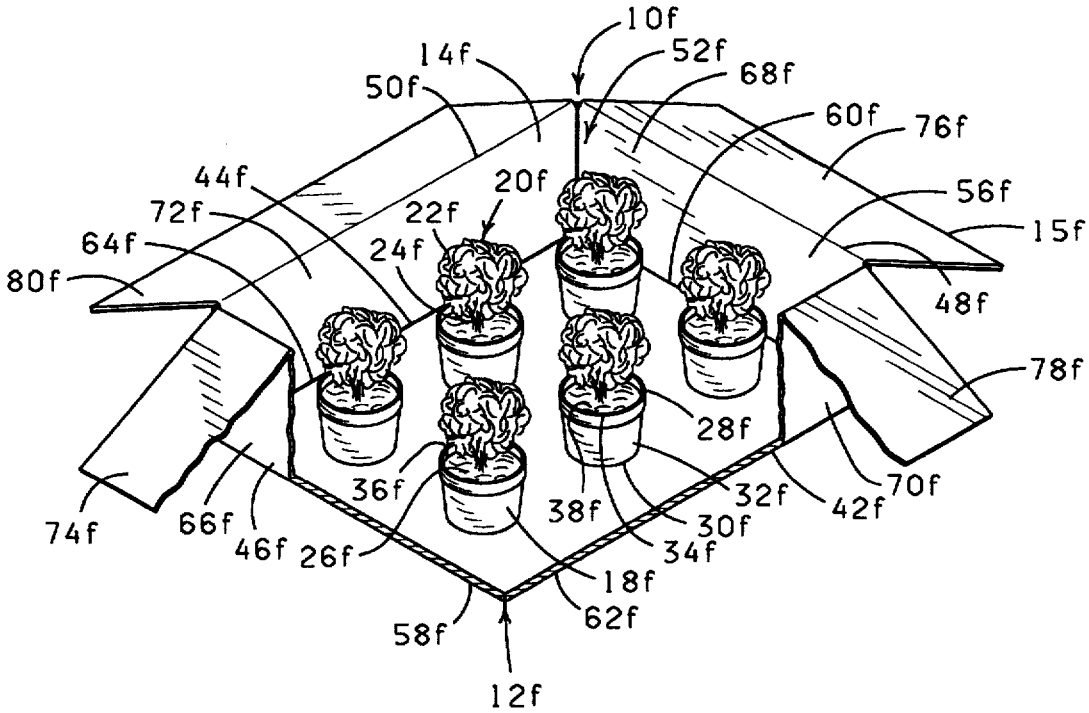
FIG. 19 is a perspective cutaway view of a box assembly showing a plurality of flower pots which contain floral grouping assemblies disposed in the box assembly.
Figure 20:
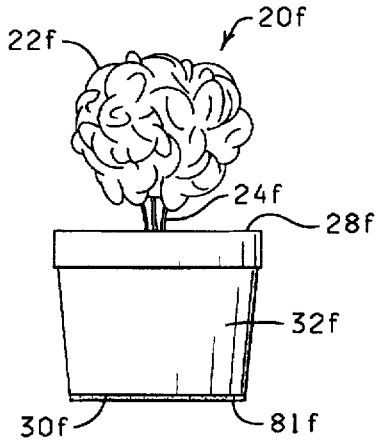
FIG. 20 is a side elevational view of one of the plurality of flower pots shown in FIG. 19, but showing the bonding material on the lower end thereof.

The Embodiments and Methods of FIGS. 18–20

Shown in FIGS. 18–20 is a modified shipping carton 10 and a modified box assembly substantially identical to the one shown in FIGS. 1–2 and described in detail previously, except that the connecting bonding material 81*f* is disposed on the lower base end 30*f* of the flower pots 18*f*, as illustrated in FIG. 20; no connecting bonding material 81*f* is disposed on the base 42*f* of the box assembly 12*f*.

In a method of operation, the method is identical to the one shown in FIGS. 1–2 and described in detail previously, except that the flower pots 18*f* are disposed one at a time in the retaining space 82*f* of the box assembly 12*f* so that the lower end base 30*f* and the connecting bonding material 81*f* thereon engages a portion of the base 42f of the box assembly 12f, thereby connecting the flower pot 18f to the base 42f of the box assembly 12f.

Figure 21:
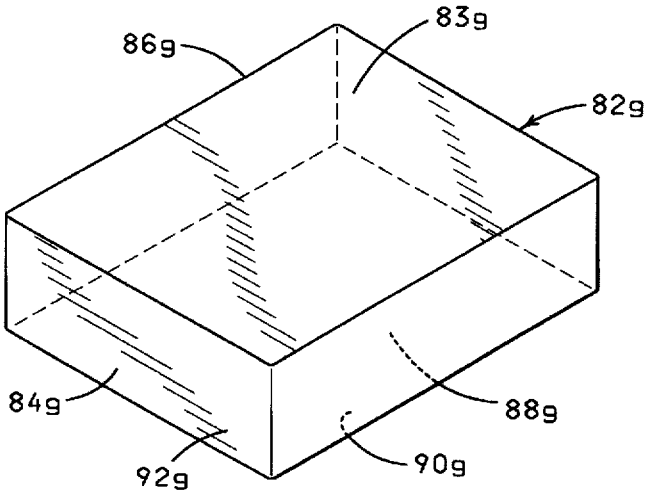
FIG. 21 is a perspective view of a box lid.
Figure 22:
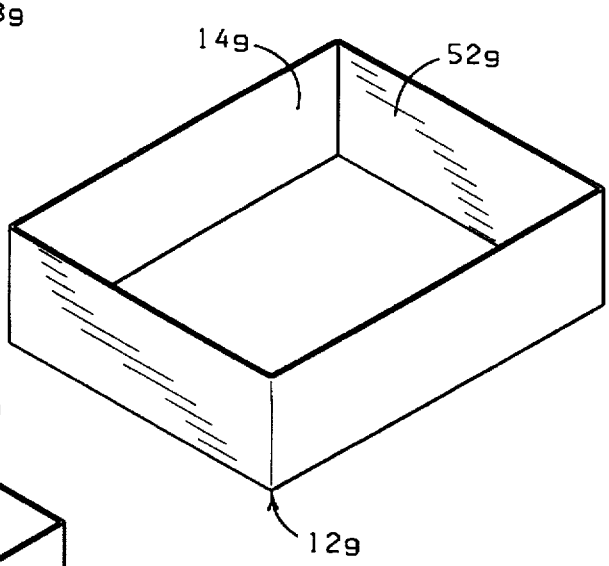
FIG. 22 is a perspective view of a box used with the box lid shown in FIG. 21 in accordance with the present invention.
Figure 23:
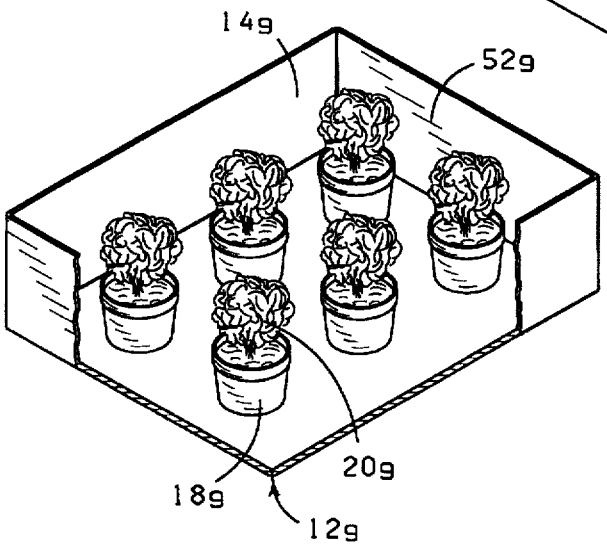
FIG. 23 is a perspective cutaway view of the box assembly shown in FIG. 22 showing flower pots containing floral groupings disposed in the box assembly.

The Embodiments and Methods of FIGS. 21–23

Shown in FIGS. 21–23 is a modified shipping carton 10g and a modified box assembly 12g substantially identical to the one shown in FIGS. 3–5 and described in detail previously, except that the connecting bonding material 81g is disposed on the lower base end 30g of the flower pots 18g; no connecting bonding material 81g is disposed on the base 42g of the box assembly 12g.

The method of operation is identical to the one shown in FIGS. 3–5 and described in detail previously, except that the flower pots 18g are disposed one at a time in the retaining space 52g of the box assembly 12g so that the lower end base 30g and the connecting bonding material 81g thereon engages a portion of the base 42g of the box assembly 12g, thereby connecting the flower pot 18g to the base 42g of the box assembly 12g.

The Embodiments and Methods of FIGS. 24–27

Shown in FIGS. 24–27 is a modified shipping carton 10h and a modified box assembly 12h substantially identical to the one shown in FIGS. 6–9 and described in detail previously, except that the connecting bonding material 81h is disposed on the lower base end 30h of the flower pots 18h; no connecting bonding material 81h is disposed on the base 42h of the box assembly 12h.

The method of operation is identical to the one shown in FIGS. 6–9 and described in detail previously, except that the flower pots 18h are disposed one at a time in the retaining space 52h of the box assembly 12h so that the lower end base 30h and the connecting bonding material 81h thereon engages a portion of the base 42h of the box assembly 12h, thereby connecting the flower pot 18h to the base 42h of the box assembly 12h.

Figure 28:
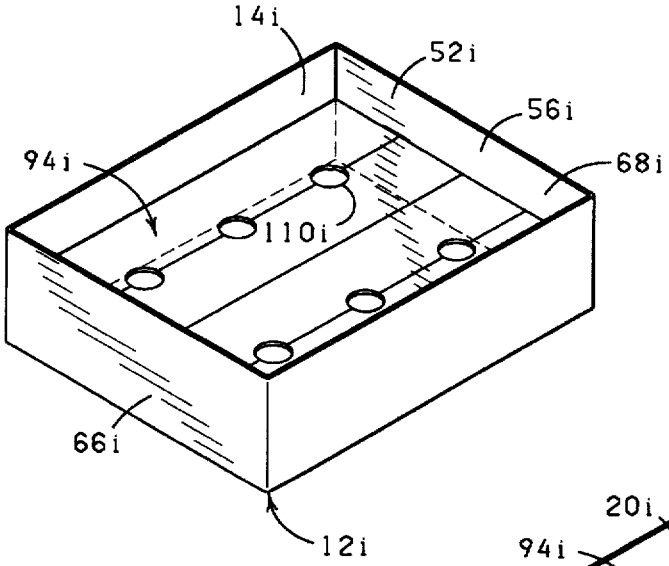
FIG. 28 is a perspective view of the box shown in FIG. 22 with retaining inserts disposed therein.
Figure 29:
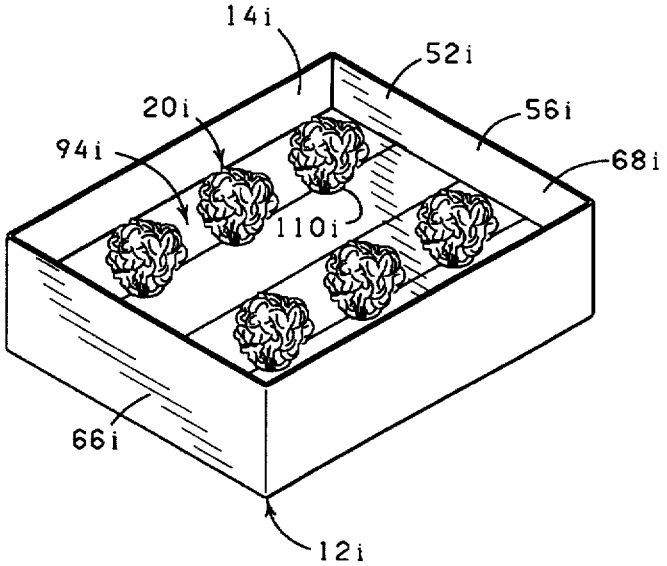
FIG. 29 is a perspective view of a box assembly similar to that in FIG. 28 showing retaining inserts and flower pots containing floral groupings disposed in the box.

The Embodiments and Methods of FIGS. 28–29

Shown in FIGS. 28–29 is a modified shipping carton 10i and a modified box assembly 12i substantially identical to the one shown in FIGS. 10–11 and described in detail previously, except that the connecting bonding material 81i is disposed on the lower base end 30i of the flower pots 18i; no connecting bonding material 81h is disposed on the base 42i of the box assembly 12i.

The method of operation is identical to the one shown in FIGS. 10–11 and described in detail previously, except that the flower pots 18i are disposed one at a time in the retaining space 52i of the box assembly 12i so that the lower end base 30i and the connecting bonding material 81i thereon engages a portion of the base 42i of the box assembly 12i, thereby connecting the flower pot 18i to the base 42i of the box assembly 12i.

Figure 30:
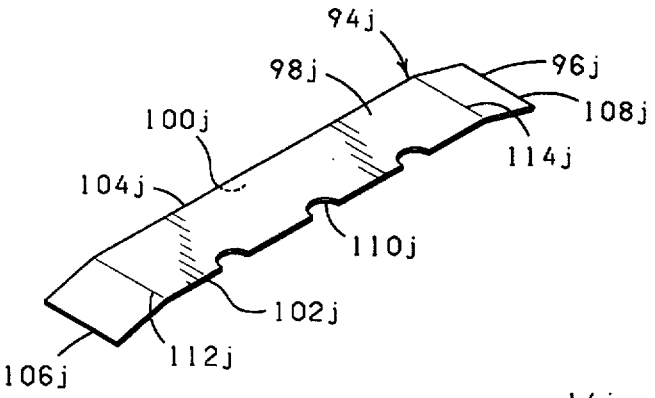
FIG. 30 is a perspective view of a retaining insert having foldable end pieces showing the ends in a partially folded position.
Figure 31:
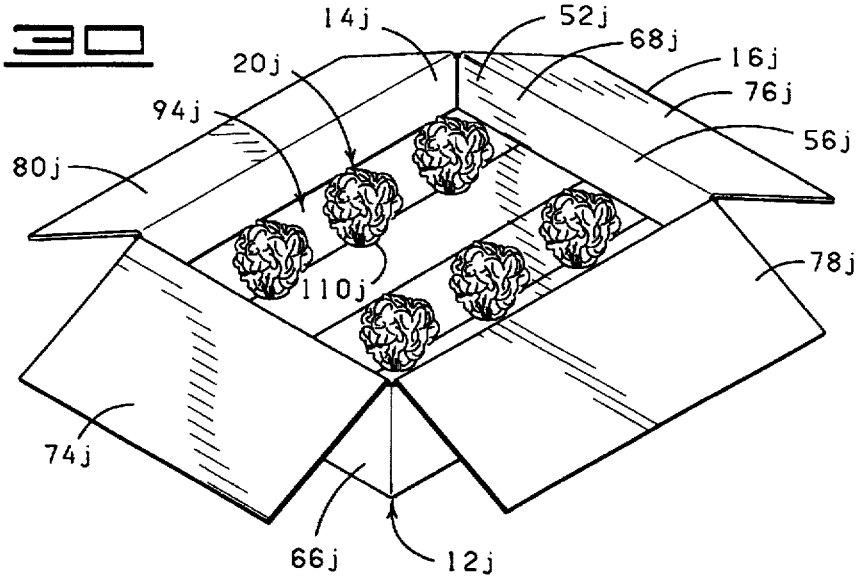
FIG. 31 is a perspective view of the box shown in FIG. 22 with retaining inserts as shown in FIG. 30 disposed therein.
Figure 32:
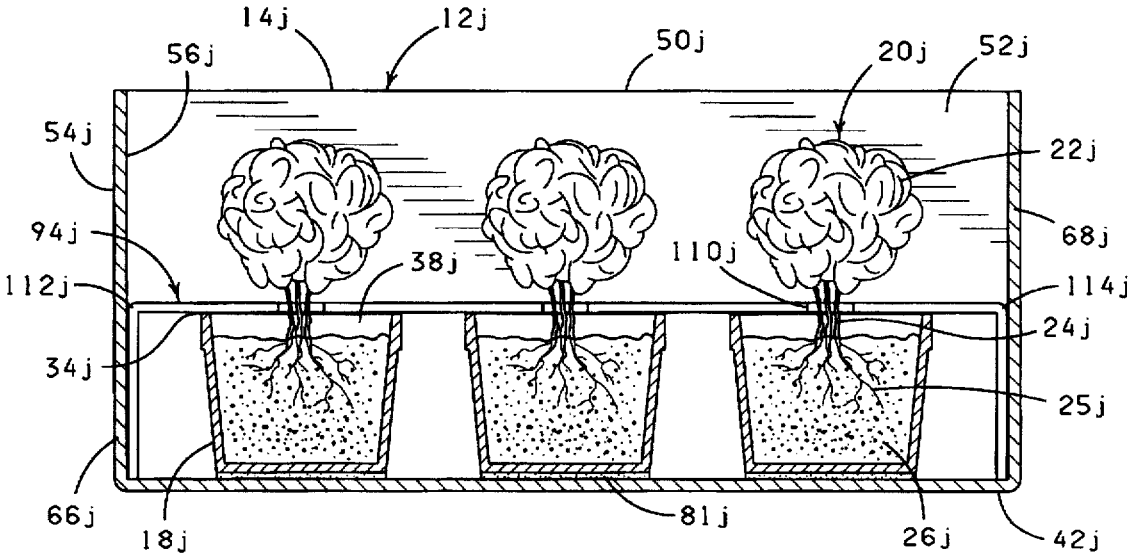
FIG. 32 is a cross section view of the box assembly shown in FIG. 31 showing the retaining inserts with foldable end pieces and the manner in which they communicate with the flower pots and floral groupings in accordance with the present invention.

The Embodiments and Methods of FIGS. 30–32

Shown in FIGS. 30–32 is a modified shipping carton 10j and a modified box assembly 12j substantially identical to the one shown in FIGS. 12–14 and described in detail previously, except that the connecting bonding material 81j is disposed on the lower base end 30j of the flower pots 18j; no connecting bonding material 81j is disposed on the base 42j of the box assembly 12j.

The method of operation is identical to the one shown in FIGS. 12–14 and described in detail previously, except that the flower pots 18j are disposed one at a time in the retaining space 52j of the box assembly 12j so that the lower end base 30j and the connecting bonding material 81j thereon engages a portion of the base 42j of the box assembly 12j, thereby connecting the flower pot 18j to the base 42j of the box assembly 12j.

Figure 33:
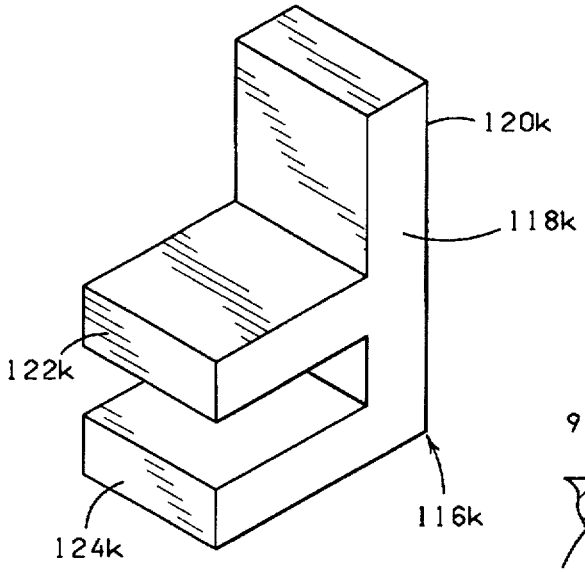
FIG. 33 is a perspective view of a clip which fastens one end of a retaining insert to an inner wall of a box assembly.
Figure 34:
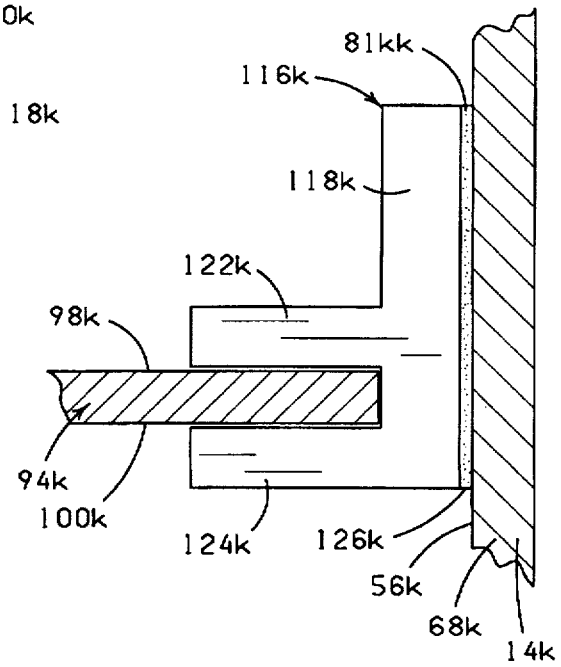
FIG. 34 is a side elevational view of a clip as it cooperates with a retaining insert.
Figure 35:
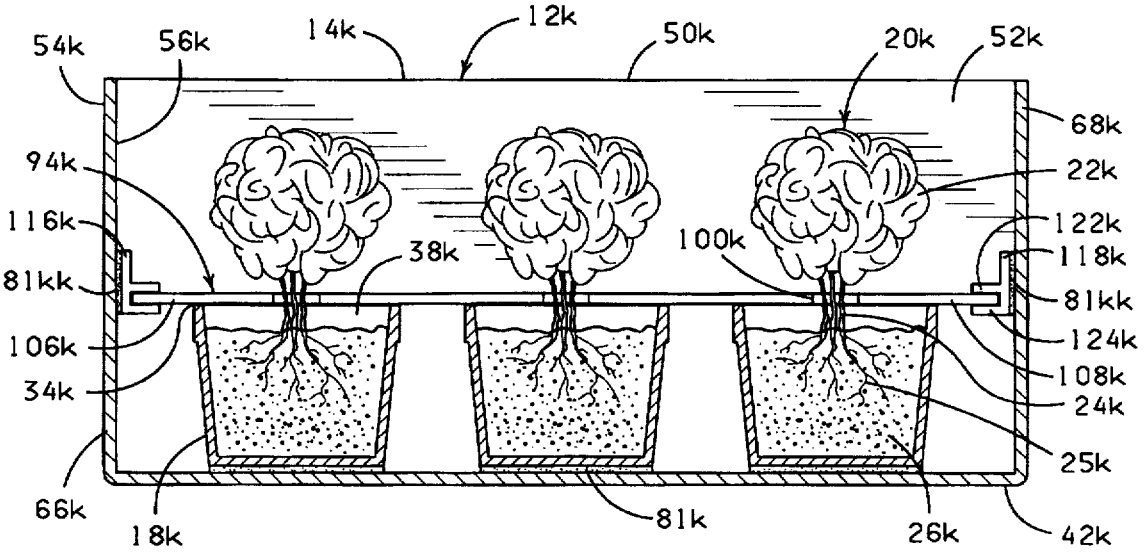
FIG. 35 is a cross section view of a box assembly shown in either FIG. 18 or FIG. 22 showing the retaining inserts and clips and the manner in which they communicate with the flower pots and floral groupings in accordance with the present invention.

The Embodiments and Methods of FIGS. 33–35

Shown in FIGS. 33–35 is a modified shipping carton 10k and a modified box assembly 12k substantially identical to the one shown in FIGS. 15–17 and described in detail previously, except that the connecting bonding material 81k is disposed on the lower base end 30k of the flower pots 18k; no connecting bonding material 81k is disposed on the base 42k of the box assembly 12k.

The method of operation is identical to the one shown in FIGS. 15–17 and described in detail previously, except that the flower pots 18k are disposed one at a time in the retaining space 52k of the box assembly 12k so that the lower end base 30k and the connecting bonding material 81k thereon engages a portion of the base 42k of the box assembly 12k, thereby connecting the flower pot 18k to the base 42k of the box assembly 12k.

Changes may be made in the construction and the operation of the various components, elements and assemblies described herein or in the steps or the sequence of steps of the methods described herein without departing from the spirit and scope of the invention as defined in the following claims.

What is claimed is:

1. A shipping assembly comprising:

a base having an inner surface and an outer surface; and one or more floral containers, each container having an upper end and a lower end and each container containing a floral grouping, each of the containers having a bonding material disposed on at least a portion of the lower end prior to its disposition upon the base, each of the containers being disposed upon the base and positioned whereby the bonding material engages and bondingly connects the lower ends of each of the containers to the inner surface of the base for substantially preventing movement of the containers in the base during movements of the base, each of the containers being removable from the box assembly by disconnecting the pots and the bonding material thereon from the base.

2. The shipping assembly of claim 1 further comprising:

a plurality of side walls connected to the base and extending a distance upwardly from the base, the side walls extending about an outer periphery of the base and cooperating with the base to at least partially form and enclose a retaining space.

3. The shipping assembly of claim 2 wherein the side walls extend upwardly from the base forming an open upper end of the shipping assembly, and wherein the shipping assembly further comprises:

a plurality of lid flaps, each lid flap being connected to an upper end of a side wall and extending along the entire length of the side wall and a distance therefrom, each flap being movable between a closed position wherein the lid flaps extend over and substantially encloses the retaining space, and an open position wherein the lid flaps are substantially removed from the open upper end of the shipping assembly.

4. The shipping assembly of claim 1 wherein the bonding material on each container is a material selected from the group of materials consisting of an adhesive and a cohesive.

5. The shipping assembly of claim 1 wherein the bonding material comprises at least one strip of bonding material disposed on the lower end of each container.

6. The shipping assembly of claim 3 wherein the base comprises a first end, a second end, a first side and a second side.

7. The shipping assembly of claim 2 wherein the side walls extend upwardly from the base forming an open upper end of the shipping assembly, and wherein the shipping assembly further comprises:

a lid removably connectable near the open upper end of the shipping assembly, the lid cooperating with the side walls and the base to encompass the retaining space in a closed position.

8. A shipping assembly comprising:

a base having an inner surface and an outer surface;

one or more floral containers, each having an upper end and a lower end, a bonding material disposed on at least a portion of the lower end of each container prior to its disposition upon the base, each container containing a growing medium, a floral grouping disposed in each container with a portion of the floral grouping extending above the upper end of each container, each of the containers being disposed upon the base and positioned whereby the bonding material engages and bondingly connects each of the containers to the base, each of the containers being removable from the base by disconnecting the bonding material on the lower end of each of the containers from the base; and at least two retaining means, each retaining means having an outer periphery, a plurality of retaining cutouts formed in said outer periphery, each of the plurality of cutouts being spaced a distance apart and each of the plurality of cutouts being sized and shaped to encompass at least a portion of the floral grouping in at least one of the containers, each retaining means being positioned near the upper end of the container wherein the plurality of cutouts on a first retaining means surrounds and encompasses a portion of the floral grouping in said and wherein the plurality of cutouts on a second retaining means cooperates with the plurality of cutouts on the first retaining means to surround and encompass a substantial portion of the floral grouping in said container, thereby both retaining means securing said floral grouping in said flower container and substantially enclosing the growing medium within said container to retain the growing medium within said container during movement of the base.

9. The shipping assembly of claim 8 further comprising:

a plurality of side walls connected to the base and extending a distance upwardly from the base, the side walls extending about an outer periphery of the base and cooperating with the base to at least partially form and enclose a retaining space.

10. The shipping assembly of claim 9 wherein the side walls extend upwardly from the base forming an open upper end of the shipping assembly, and wherein the shipping assembly further comprises:

a plurality of lid flaps, each lid flap being connected to an upper end of a side wall and extending along the entire length of the side wall and a distance therefrom, each flap being movable between a closed position wherein the lid flaps extend over and substantially encloses the retaining space, and an open position wherein the lid flaps are substantially removed from the open upper end of the shipping assembly.

11. The shipping assembly of claim 8 wherein the bonding material on each floral container is a material selected from the group of materials consisting of an adhesive and a cohesive.

12. The shipping assembly of claim 8 wherein the base comprises a first end, a second end, a first side and a second side.

13. The shipping assembly of claim 12 wherein the retaining means may be further defined as each having two fold lines, the distance between said fold lines approximating the distance between the first and second ends of the base, and the distance between each fold line and the end of the retaining means most proximal to that fold line approximating the height of the floral containers, whereby the sections of the retaining means between the fold lines and the first and second ends of the base are moveable to a position wherein said sections extend approximately perpendicularly to the portion of the retaining means between the fold lines such that the ends of each of the retaining means cooperate with the base to provide additional support to each of the retaining means.

14. The shipping assembly of claim 8 further comprising: means for securing each retaining means to the base.

15. The shipping assembly of claim 14 in which the means for securing each retaining means to the base comprises a clip.

16. The shipping assembly of claim 9 wherein the side walls extend upwardly from the base forming an open upper end of the shipping assembly, and wherein the shipping assembly further comprises:

a lid removably connectable near the open upper end of the shipping assembly, the lid cooperating with the side walls and the base to encompass the retaining space in a closed position.

17. The shipping assembly of claim 16 wherein the base comprises a first end, a second end, a first side and a second side.

18. A method for shipping floral groupings, comprising the steps of:

providing a shipping assembly comprising a base and a lid, the base comprising an inner surface and an outer surface;

providing at least one floral container having an open upper end, a lower end and a retaining space sized to receive and retain a floral grouping therein, a floral grouping being disposed therein, a connecting bonding material disposed on at least a portion of the lower end of the container; and disposing the floral container upon the base of the shipping assembly such that the lower end of the floral container and the connecting bonding material thereon engages the base of the shipping assembly thereby bondingly connecting the floral container to the base of the shipping assembly.

19. The method of claim 18 further comprising the step of moving the lid to a closed position whereby the floral container containing the floral grouping is substantially enclosed.

20. The method of claim 19 wherein the lid of the shipping assembly further comprises a first lid flap, a second lid flap, a third lid flap and a fourth lid flap, and the step of moving the lid to a closed position further comprises:

moving the first lid flap to a closed position whereby the first lid flap partially encloses the base and floral container;

moving the second lid flap to a closed position whereby the second lid flap partially encloses the base and floral container;

moving the third lid flap to a closed position whereby the third lid flap partially covers the first and second lid flaps; and moving the fourth lid flap to a closed position whereby the fourth lid flap substantially covers the portions of the first and second lid flaps not covered by the third lid flap, thereby substantially enclosing the floral container containing the floral grouping and the base.

21. The method of claim 20 further comprising the step of securing each lid flap in the closed position with an adhesive tape or other securing means.

22. The method of claim 18 wherein the shipping assembly further comprises side walls and wherein the lid is removably connectable near an open upper end of the shipping assembly, and the step of moving the lid to a closed position comprises:

connecting the lid to the shipping assembly whereby the lid cooperates with the side walls and the base of the shipping assembly to encompass a retaining space of the shipping assembly.

23. The method of claim 22 further comprising the step of securing the lid in the closed position with an adhesive tape or other securing means.

24. The method of claim 18 further comprising the steps of:

providing a plurality of retaining means, each retaining means having at least one cutout;

disposing the retaining means upon the base of the shipping assembly; and positioning the retaining means near the open upper end of the floral container, the cutout of each of the plurality of retaining means positioned to surround at least a portion of the floral grouping thereby securing the floral grouping in the floral container.

25. The method of claim 24 wherein the shipping assembly further comprises a retaining space defined by a plurality of side walls, opposing side walls having a width therebetween, and wherein the retaining means are approximately the same length as the width between two of the opposing of side walls, whereby the retaining means are held in place by the force exerted on the retaining means by the side walls of the shipping assembly after the retaining means are disposed in the retaining space of the shipping assembly.

26. The method of claim 24 further comprising the step of moving the lid to a closed position whereby the retaining space of the shipping assembly and the floral containers containing the floral groupings are substantially enclosed within the retaining space of the shipping assembly.

27. The method of claim 26 further comprising the step of securing the lid in the closed position with an adhesive tape or other securing means.

28. The method of claim 24 wherein in the step of positioning the retaining means, the floral container further comprises a growing medium, and the retaining means cooperate to at least partially enclose the growing medium in the retaining space of the floral container.

29. The method of claim 24 wherein the shipping assembly further comprises a retaining space defined by a plurality of side walls, opposing side walls having a width therebetween, wherein each of the plurality of retaining means further comprises a first end and a second end, wherein the retaining means have a length greater than the width between at least two of the opposing side walls, and wherein at least one end of each of the retaining means is folded, thereby forming both a folded portion of the retaining means and an unfolded portion of the retaining means, the unfolded portion of each of the retaining means having a length approximately equal to the width between at least two of the opposing side walls, whereby the retaining means are frictionally held in place by the force exerted on the retaining means by the side walls of the shipping assembly.

30. The method of claim 24 wherein in the step of positioning the retaining inserts, the retaining space is defined by a plurality of side walls, opposing side walls having a width therebetween, wherein each of the plurality of side walls further comprises a clip capable of connecting to an end of at least one of the plurality of retaining inserts, wherein the retaining inserts further comprise a first end and a second end, wherein the retaining inserts have a length approximately equal to the width between at two of the opposing side walls, and wherein both the first end and the second end of each of the plurality of retaining inserts are each connected to and held in place by at least one clip after the retaining inserts are disposed in the retaining space of the shipping assembly.

31. A method for shipping floral groupings, comprising the steps of:

providing a shipping assembly having a base comprising an inner surface and an outer surface;

providing at least one floral container having an open upper end, a lower end and a retaining space having a floral grouping therein, the lower end of the floral container having a bonding material disposed thereon;

disposing the floral container upon the base; and positioning the floral container such that the lower end of the floral container and the bonding material thereon bondingly engages and connects the lower end of the floral container to at least a portion of the base for substantially preventing movement of the floral container on the base during movements of the base, the floral container being removable from the base by disconnecting the floral container from the base.

32. The method of claim 31 further comprising the steps of:

providing a plurality of retaining means, each retaining means having at least one cutout;

disposing the retaining means upon the base of the shipping assembly; and positioning the retaining means near the open upper end of the floral container, the cutout of each of the plurality of retaining means positioned to surround at least a portion of the floral grouping thereby securing the floral grouping in the floral container.

33. The method of claim 32 wherein the shipping assembly further comprises a plurality of side walls, opposing side walls having a width therebetween, and wherein the retaining means are approximately the same length as the width between two of the opposing of side walls, whereby the retaining means are held in place by the force exerted on the retaining means by the side walls of the shipping assembly after the retaining means are disposed about the floral containers.

34. The method of claim 32 wherein in the step of positioning the retaining means, the floral container further comprises a growing medium, and the retaining means cooperate to at least partially enclose the growing medium in the retaining space of the floral container.

35. A method for shipping floral groupings, comprising the steps of:

providing a shipping carton having a base comprising an inner surface having a retaining space and an outer surface;

providing at least one floral container having an open upper end, a lower end and a retaining space sized to receive and retain both a growing medium and a floral grouping therein, the lower end of the floral container having a bonding material disposed thereon;

disposing the floral container in the retaining space;

positioning the floral container such that the lower end of the floral container and the bonding material bondingly engages and connects the lower end of the floral container to at least a portion of the retaining space of the base for substantially preventing movement of the container in the base during movements of the base, the floral container being removable from the base by disconnecting the floral container from the base;

providing a plurality of retaining means, each of said means having at least one cutout;

disposing the retaining means within the retaining space of the base;

positioning the retaining means near the upper end of the floral container, the cutout of each retaining means positioned to surround at least a portion of the floral grouping to both secure the floral grouping in the floral grouping and to enclose at least a portion of the growing medium within the retaining space of the floral container.

36. The method of claim 35 wherein in the step of providing a shipping carton, the shipping carton further comprises a lid; and moving the lid to a closed position whereby the retaining space of the shipping carton and the floral container containing the floral grouping is substantially enclosed within the retaining space of the shipping carton.

37. The method of claim 36 wherein the shipping carton further comprises a first lid flap, a second lid flap, a third lid flap and a fourth lid flap, and the step of moving the shipping carton lid to a closed position comprises:

moving the first lid flap to a closed position whereby the first lid flap partially encloses the retaining space of the shipping carton;

moving the second lid flap to a closed position whereby the second lid flap partially encloses the retaining space of the shipping carton;

moving the third lid flap to a closed position whereby the third lid flap partially covers the first and second lid flaps; and moving the fourth lid flap to a closed position whereby the fourth lid flap substantially covers the portions of the first and second lid flaps not covered by the third lid flap, thereby substantially enclosing the floral container containing the floral grouping within the retaining space of the shipping carton.

38. The method of claim 37 further comprising the step of securing each lid flap in the closed position with an adhesive tape or other securing means.

39. The method of claim 35 wherein the shipping carton further comprises side walls, and a shipping carton lid that is removably connectable to the open upper end of the base, and the step of moving the shipping carton lid to a closed position comprises:

connecting the shipping carton lid to the shipping carton whereby the shipping carton lid cooperates with the side walls and the base of the shipping carton to encompass the retaining space of the shipping carton.

40. The method of claim 39 further comprising the step of securing the shipping carton lid in the closed position with an adhesive tape or other securing means.

41. The method of claim 35 wherein the retaining space is defined by a plurality of side walls, opposing side walls having a width therebetween, and wherein the retaining means are approximately the same length as the width between two of the opposing of side walls, whereby the retaining means are held in place by the force exerted on the retaining means by the side walls of the shipping carton after the retaining means are disposed in the retaining space of the shipping carton.

42. The method of claim 35 further comprising the step of providing a shipping carton lid; and moving the shipping carton lid to a closed position whereby the retaining space of the shipping carton and the containing the floral grouping is substantially enclosed within the retaining space of the shipping carton.

43. The method of claim 42 further comprising the step of securing the shipping carton lid in the closed position with an adhesive tape or other securing means.

44. The method of claim 35 wherein in the step of positioning the remaining means, the retaining space is defined by plurality of side walls, opposing side walls having a width therebetween, wherein each of the plurality of retaining means further comprise a first end and a second end, wherein the retaining means have a length greater than the width between at least two of the opposing side walls, and wherein at least one end of each of the retaining means is folded, thereby forming both a folded portion of the retaining means and an unfolded portion of the retaining means, the unfolded portion of each of the retaining means having a length approximately equal to the width between at least two of the opposing side walls, whereby the retaining means are frictionally held in place by the force exerted on the retaining means by the side walls of the shipping carton after the retaining means are disposed in the retaining space of the shipping carton.

45. The method of claim 35 wherein in the step of positioning the retaining means, the retaining space is defined by a plurality of side walls, opposing side walls having a width therebetween, wherein each of the plurality of side walls further comprises a clip capable of connecting to an end of at least one of the plurality of retaining means, wherein the retaining means have a length approximately equal to the width between at two of the opposing side walls, and wherein both the first end and the second end of each of the plurality of retaining means are each connected to and held in place by at least one clip after the retaining means are disposed in the retaining space of the shipping carton.

46. A shipping assembly comprising:

a base having an inner surface and an outer surface; and one or more floral containers, each container having an upper end and a lower end and each containing a floral grouping an adhesive or cohesive, each of the containers having bonding material disposed on at least a portion of the lower end prior to its disposition upon the base, each of the containers being disposed upon the base and positioned whereby the adhesive or cohesive bonding material engages and bondingly connects the lower ends of each of the floral containers to the inner surface of the base for substantially preventing movement of the floral containers in the base during movements of the base, each of the floral containers being removable from the base by disconnecting the container and the bonding material thereon from the base.

47. A method for shipping containers, comprising the steps of:

providing a shipping assembly having a base comprising an inner surface and an outer surface;

providing at least one floral container, the floral container having an open upper end, a lower end and a retaining space and having a floral grouping disposed therein, the lower end of the floral container having an adhesive or cohesive bonding material disposed thereon;

disposing the floral container on the base; and positioning the floral container such that the lower end of the floral container and the bonding material thereon bondingly engages and connects the lower end of the floral container to at least a portion of the base for substantially preventing movement of the floral container on the base during movements of the base, the floral container being removable from the base by disconnecting the floral container from the base.

* * * * *

UNITED STATES PATENT AND TRADEMARK OFFICE

CERTIFICATE OF CORRECTION

| | | | |
|---|---|---|---|
| PATENT NO. | : | 5,692,612 | Page 1 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 3 of 12, Figure 6, please delete drawing element "110" next to '106', and substitute therefor --100-- as illustrated below:

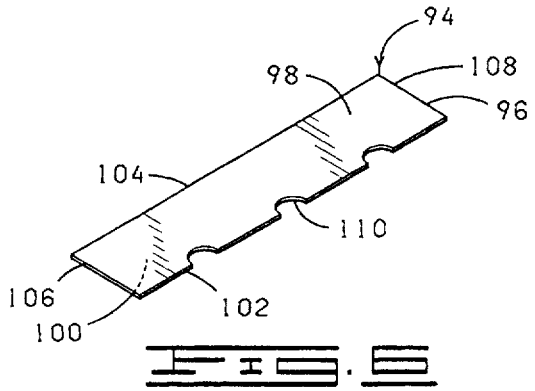

FIG. 6

UNITED STATES PATENT AND TRADEMARK OFFICE

CERTIFICATE OF CORRECTION

| | | | |
|---|---|---|---|
| PATENT NO. | : | 5,692,612 | Page 2 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 3 of 12, Figure 7, please delete drawing element "16b", and substitute therefor --15b-- as illustrated below:

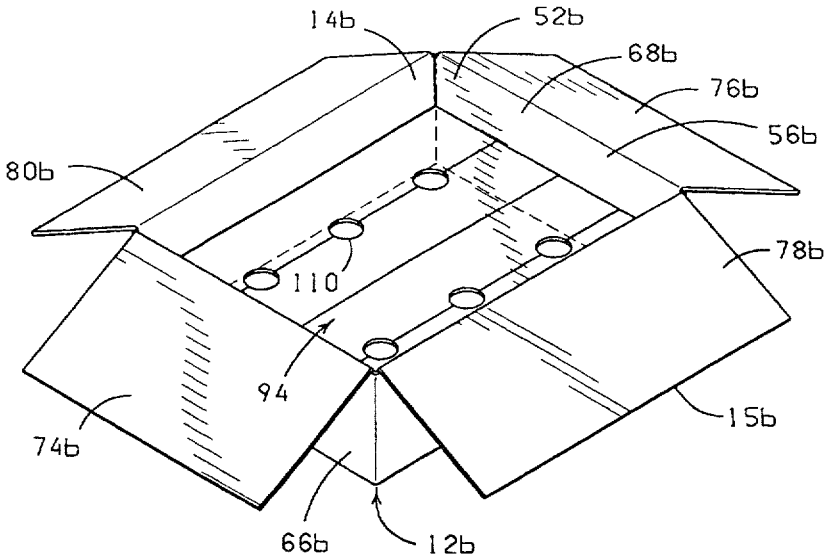

FIG. 7

UNITED STATES PATENT AND TRADEMARK OFFICE

CERTIFICATE OF CORRECTION

| | | | |
|---|---|---|---|
| PATENT NO. | : | 5,692,612 | Page 3 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 3 of 12, Figure 8, please delete drawing element "16b", and substitute therefor --15b-- as illustrated below:

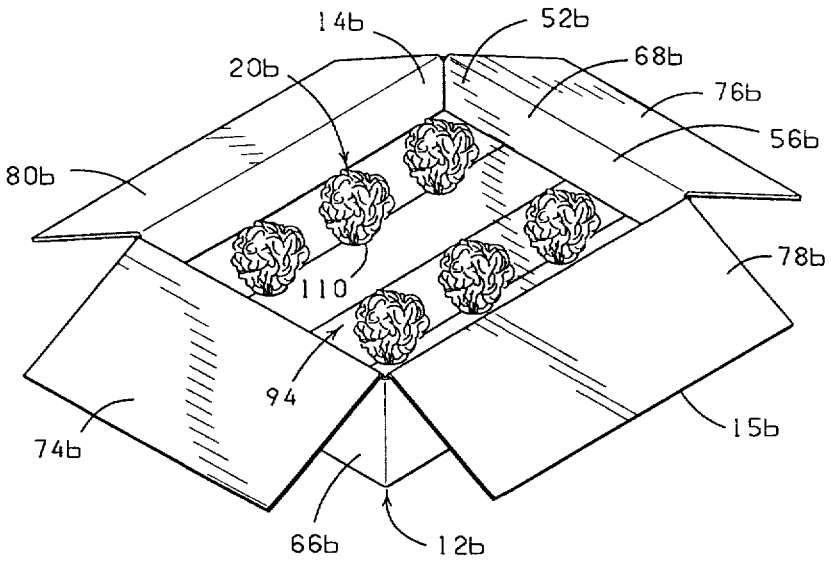

FIG. 8

UNITED STATES PATENT AND TRADEMARK OFFICE

CERTIFICATE OF CORRECTION

| | | | |
|---|---|---|---|
| PATENT NO. | : | 5,692,612 | Page 4 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 4 of 12, Figure 9, please delete drawing element "94b", and substitute therefor --94-- as illustrated below:

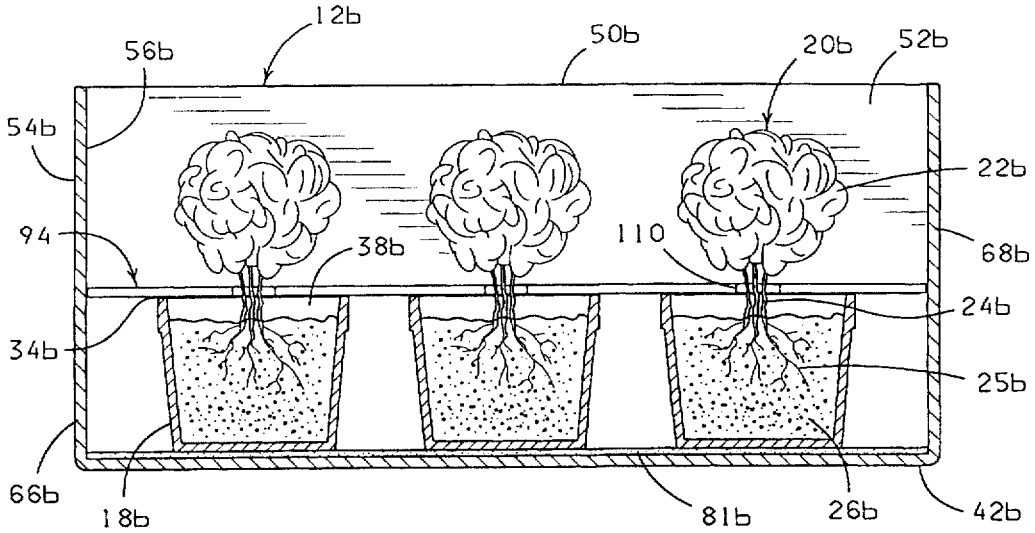

FIG. 9

UNITED STATES PATENT AND TRADEMARK OFFICE

CERTIFICATE OF CORRECTION

| | | | |
|---|---|---|---|
| PATENT NO. | : | 5,692,612 | Page 5 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 4 of 12, Figure 11, please delete drawing element "20", and substitute therefor --20c-- as illustrated below:

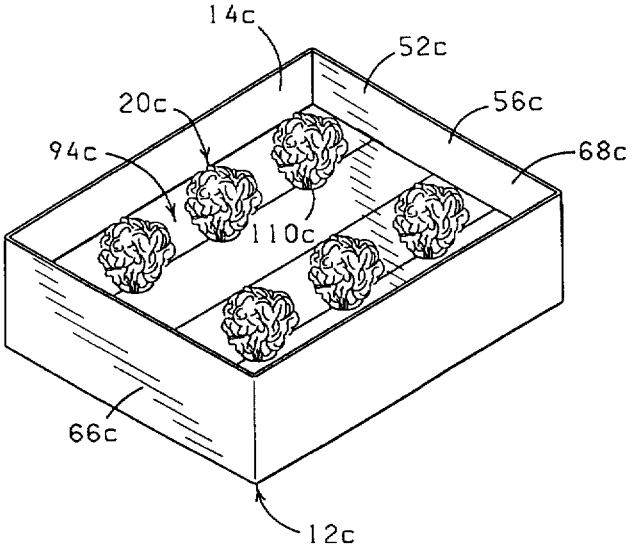

FIG. 11

UNITED STATES PATENT AND TRADEMARK OFFICE

CERTIFICATE OF CORRECTION

| | | | |
|---|---|---|---|
| PATENT NO. | : | 5,692,612 | Page 6 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 5 of 12, Figure 13, please delete drawing element "16d", and substitute therefor --15d-- as illustrated below:

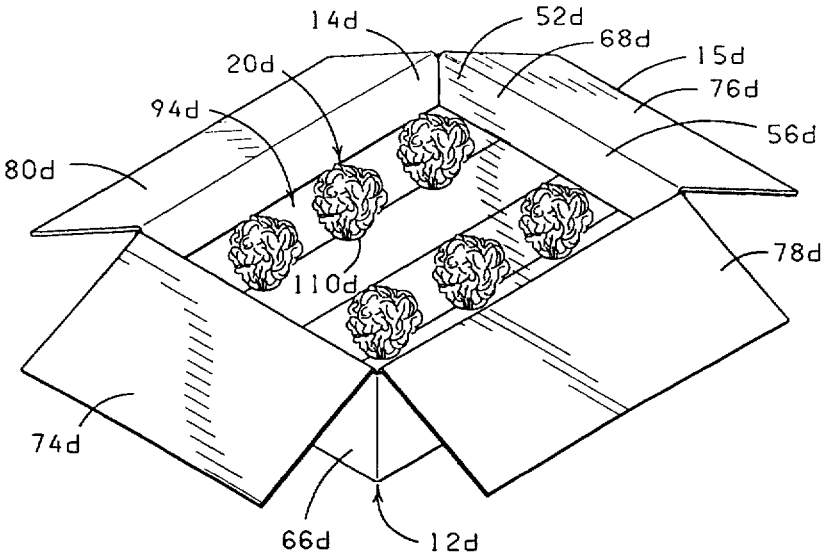

FIG. 13

UNITED STATES PATENT AND TRADEMARK OFFICE

CERTIFICATE OF CORRECTION

| | | | |
|---|---|---|---|
| PATENT NO. | : | 5,692,612 | Page 7 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 6 of 12, Figure 17, please delete drawing element "100e", and substitute therefor --110e-- as illustrated below:

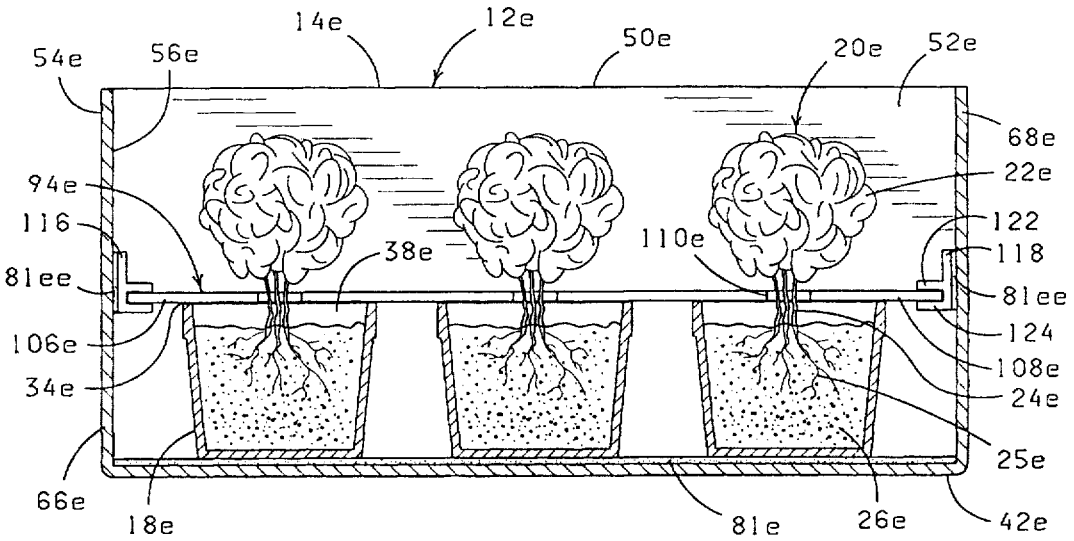

FIG. 17

UNITED STATES PATENT AND TRADEMARK OFFICE

CERTIFICATE OF CORRECTION

| | | | |
|---|---|---|---|
| PATENT NO. | : | 5,692,612 | Page 8 of 13 |
| DATED | : | December 2, 1997 | |
| INVENTOR(S) | : | Donald E. Weder et al. | |

Figure 24:
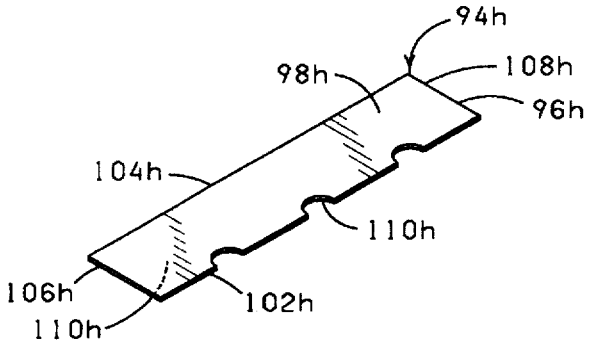
FIG. 24 is a perspective view of a retaining insert constructed in accordance with the present invention.

It is certified that error appears in the above-identified patent and that said Letters Patent is hereby corrected as shown below:

Sheet 9 of 12, Figure 24, please delete drawing element "110h", next to '106h', and substitute therefor --100h-- as illustrated below:

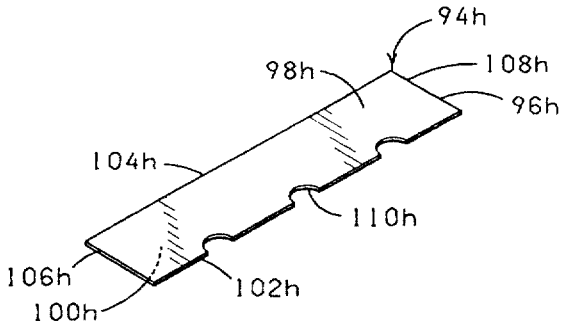

FIG. 24

UNITED STATES PATENT AND TRADEMARK OFFICE

CERTIFICATE OF CORRECTION

| | | | |
|---|---|---|---|
| PATENT NO. | : | 5,692,612 | Page 9 of 13 |
| DATED | : | December 2, 1997 | |
| INVENTOR(S) | : | Donald E. Weder et al. | |

Figure 25:
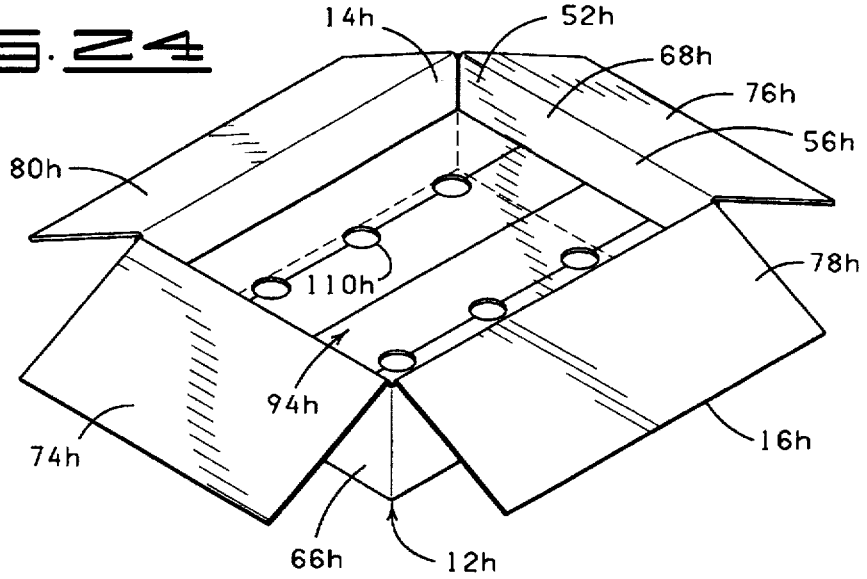
FIG. 25 is a perspective view of the box assembly shown in FIG. 18 with retaining inserts disposed therein.

It is certified that error appears in the above-identified patent and that said Letters Patent is hereby corrected as shown below:

Sheet 9 of 12, Figure 25, please delete drawing element "16h", and substitute therefor --15h-- as illustrated below:

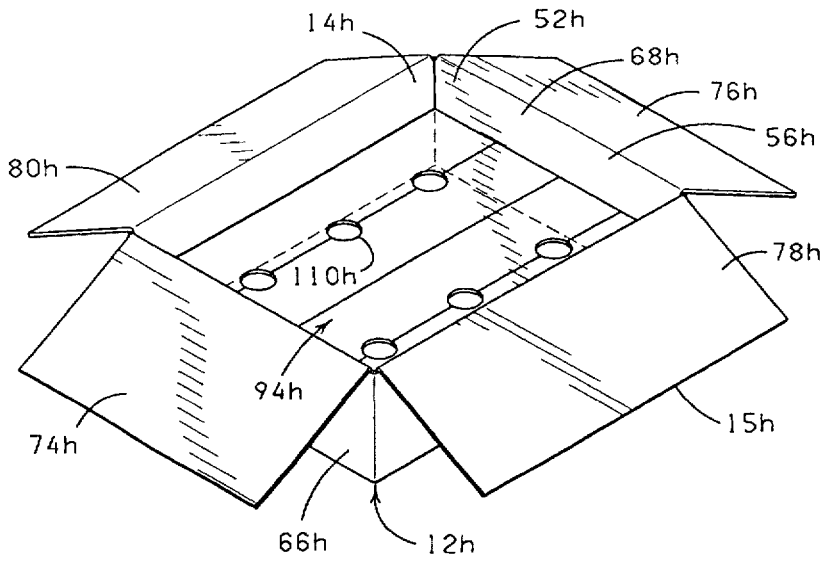

FIG. 25

UNITED STATES PATENT AND TRADEMARK OFFICE

CERTIFICATE OF CORRECTION

| | | | |
|---|---|---|---|
| PATENT NO. | : | 5,692,612 | Page 10 of 13 |
| DATED | : | December 2, 1997 | |
| INVENTOR(S) | : | Donald E. Weder et al. | |

Figure 26:
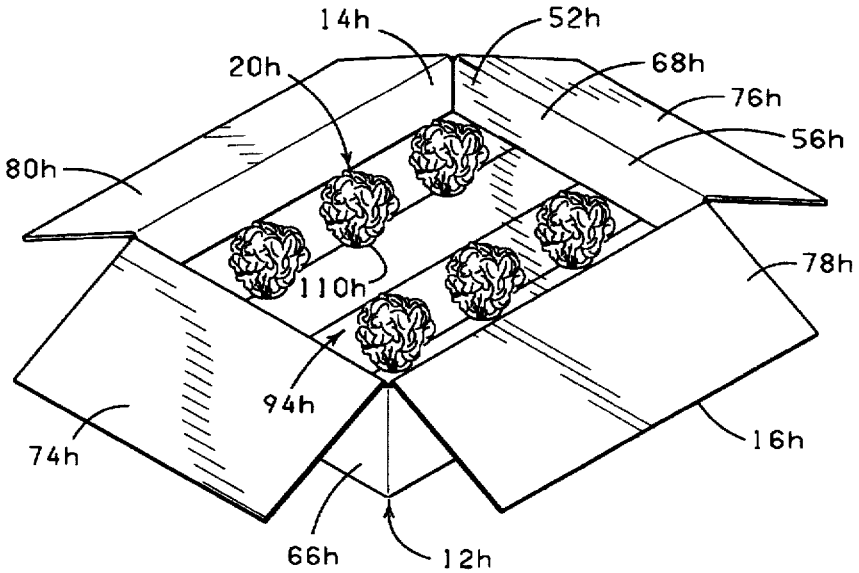
FIG. 26 is a perspective view of a box assembly similar to that in FIG. 18 having retaining inserts, flower pots and floral groupings disposed in the flower pots.
Figure 27:
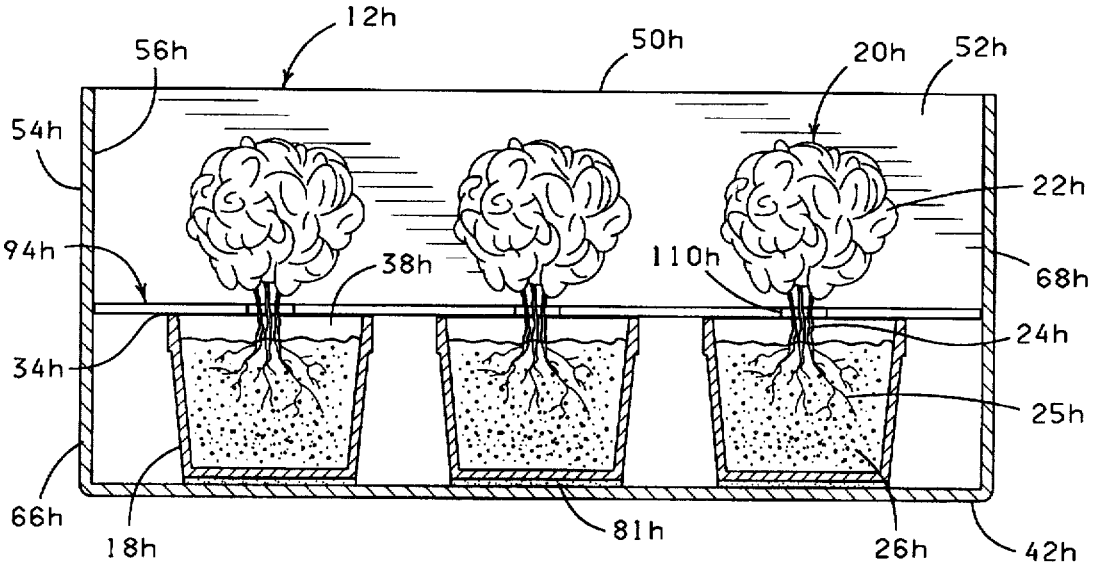
FIG. 27 is a cross section view of a box assembly shown in FIG. 26 showing the retaining inserts and the manner in which they communicate with the flower pots and floral groupings in accordance with the present invention.

It is certified that error appears in the above-identified patent and that said Letters Patent is hereby corrected as shown below:

Sheet 9 of 12, Figure 26, please delete drawing element "16h", and substitute therefor --15h-- as illustrated below:

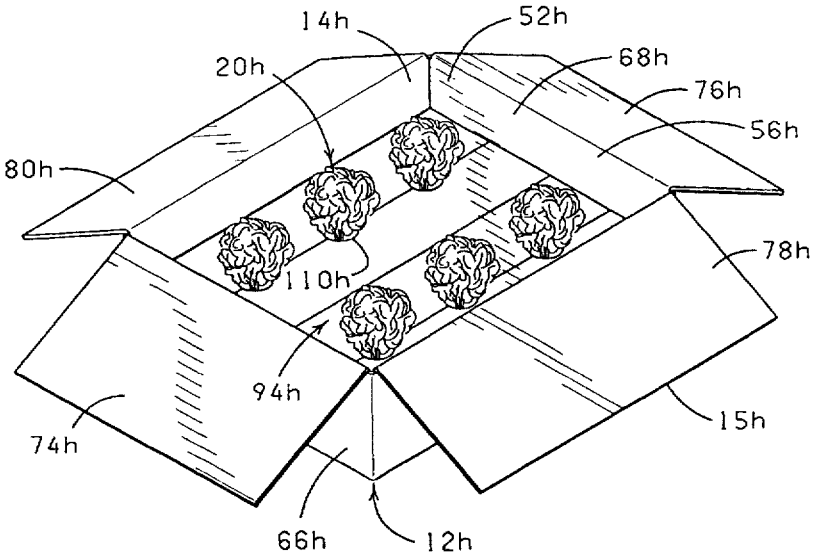

FIG. 26

UNITED STATES PATENT AND TRADEMARK OFFICE

CERTIFICATE OF CORRECTION

| | | | |
|---|---|---|---|
| PATENT NO. | : | 5,692,612 | Page 11 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Sheet 12 of 12, Figure 35, please delete drawing element "100k", and substitute therefor --110k-- as illustrated below:

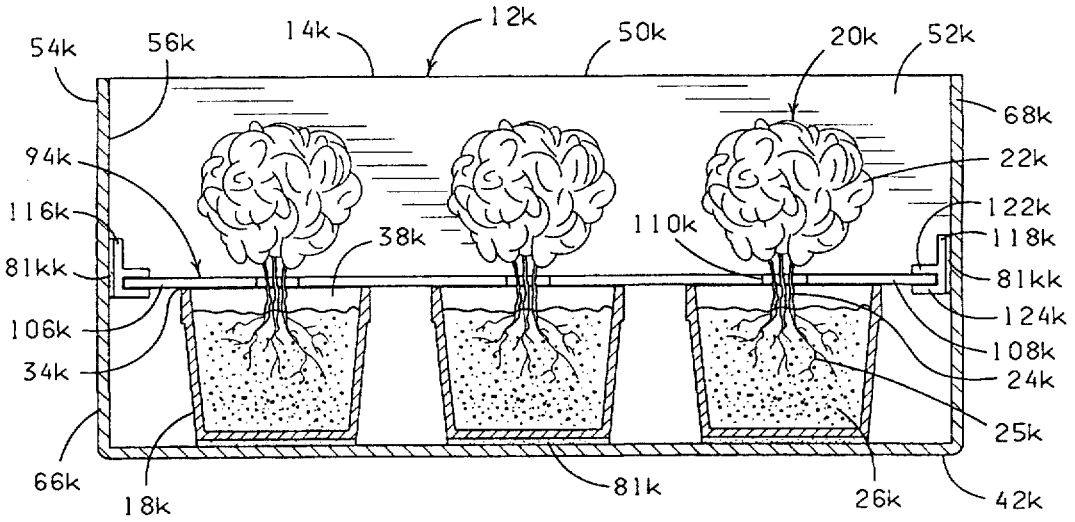

FIG. 35

UNITED STATES PATENT AND TRADEMARK OFFICE

CERTIFICATE OF CORRECTION

PATENT NO. : 5,692,612

DATED : December 2, 1997

INVENTOR(S) : Donald E. Weder et al.

It is certified that error appears in the above-identified patent and that said Letters Patent is hereby corrected as shown below:

Column 4, line 10, after 'box lid', please delete "82".

Column 5, line 23, please delete "12", and substitute therefor --12a--.

Column 5, line 24, please delete "14", and substitute therefor --14a--.

Column 6, line 3, please delete "15", and substitute therefor --82--.

Column 6, line 35, after 'box assembly', please delete "18b", and substitute therefor --12b--.

Column 6, line 67, please delete "94b", and substitute therefor --94--.

Column 7, line 3, please delete "76b and 78b", and substitute therefor --78b and 80b--.

Column 8, line 17, after 'box lid', please delete "15", and substitute therefor --82--.

UNITED STATES PATENT AND TRADEMARK OFFICE

CERTIFICATE OF CORRECTION

| | | | |
|---|---|---|---|
| PATENT NO. | : | 5,692,612 | Page 13 of 13 |
| DATED | : | December 2, 1997 | |
| INVENTOR(S) | : | Donald E. Weder et al. | |

It is certified that error appears in the above-identified patent and that said Letters Patent is hereby corrected as shown below:

Column 9, line 9, please delete "ends", and substitute therefor --walls--.

Column 10, line 56, after 'shipping carton', please delete "10", and substitute therefor --10f--.

Column 10, line 66, please delete "82f", and substitute therefor --52f--.

Column 13, line 41, after 'grouping in said', please insert --container--.

Signed and Sealed this

Eleventh Day of August 1998

Bruce Lehman

*Attest:*

BRUCE LEHMAN

*Attesting Officer*

*Commissioner of Patents and Trademarks*